US005659328A

United States Patent [19]

Todokoro et al.

[11] Patent Number: 5,659,328

[45] Date of Patent: Aug. 19, 1997

[54] ELECTRON BEAM GENERATING APPARATUS, IMAGE DISPLAY APPARATUS, AND METHOD OF DRIVING THE APPARATUS

[75] Inventors: Yasuyuki Todokoro, Yokohama; Hidetoshi Suzuki, Fujisawa, both of Japan

[73] Assignee: Canon Kabushiki Kaisha, Tokyo, Japan

[21] Appl. No.: 358,728

[22] Filed: Dec. 19, 1994

[30] Foreign Application Priority Data

Dec. 22, 1993 [JP] Japan ..... 5-32373
Dec. 8, 1994 [JP] Japan ..... 6-304782

[51] Int. Cl.[6] ..... H01J 3/08

[52] U.S. Cl. ..... 345/74; 348/177

[58] Field of Search ..... 313/309, 310, 313/336, 346 R, 351, 355, 495, 497; 345/30, 74, 75, 147, 77; 324/158.1, 411, 751; 315/3, 150, 155, 168, 169.1, 169.3, 169.4, 366; 250/423 F, 492.2, 492.3; 341/5; 348/177

[56] References Cited

U.S. PATENT DOCUMENTS

| | | | |
|---|---|---|---|
| 4,441,097 | 4/1984 | Anderson | 341/5 |
| 4,825,082 | 4/1989 | Okunuki et al. | 250/423 F |
| 4,894,611 | 1/1990 | Shimoda et al. | 324/158 R |
| 4,954,744 | 9/1990 | Suziuki et al. | 313/336 |
| 4,956,578 | 9/1990 | Shimizu et al. | 315/3 |
| 5,025,196 | 6/1991 | Suzuki et al. | 315/168 |
| 5,066,883 | 11/1991 | Yoshioka et al. | 313/309 |
| 5,136,212 | 8/1992 | Eguchi et al. | 315/150 |
| 5,155,416 | 10/1992 | Suzuki et al. | 315/366 |
| 5,185,554 | 2/1993 | Nomura et al. | 313/495 |
| 5,262,698 | 11/1993 | Dunham | 315/169.1 |

FOREIGN PATENT DOCUMENTS

| | | |
|---|---|---|
| 63-051026 | 3/1988 | Japan . |
| 64-31332 | 2/1989 | Japan . |
| 2257551 | 10/1990 | Japan . |
| 4137431 | 5/1992 | Japan . |
| WO8505491 | 12/1985 | WIPO . |

OTHER PUBLICATIONS

H. Araki, et al., "Electroforming and Electron Emission of Carbon Thin Films", Journal of Vacuum Society of Japan, vol. 26, No. 1, pp. 22–29 (Jan. 1983).

M. Hartwell et al., "Strong Electron Emission From Patterned Tin–Indium Oxide Thin Films", International Electron Devices Meeting, pp. 519–521 (1975).

G. Dittmer, "Electrical Conduction and Electron Emission of Discontinuous Thin Films", Thin Solid Films, vol. 9, pp. 317–328 (1972).

M.I. Elinson et al., "The Emission of Hot Electrons and the Field Emission of Electrons From Tin Oxide", Radio Engineering and Electronic Physics, No. 7, pp. 1290–1296 (Jul. 1965).

C.A. Mead, "Operation of Tunnel–Emission Devices", Journal of Applied Physics, vol. 32, No. 4, pp. 646–652 (April 1961).

(List continued on next page.)

*Primary Examiner*—Mark R. Powell
*Assistant Examiner*—Seth D. Vail
*Attorney, Agent, or Firm*—Fitzpatrick, Cella, Harper & Scinto

[57] ABSTRACT

An electron beam generating apparatus for an electron beam source having surface conduction electron emitting devices formed on a substrate; includes a measuring unit for measuring a device current flowing through each of the surface conduction electron emitting devices, an a device current storage unit for storing data measured by the measuring unit. In addition comparing unit compares latest data measured by the measuring unit with the data stored in the device current storage unit, a correction value storage unit stores a correction value for correcting a driving signal to be applied to each surface conduction electron emitting device, and an adjusting unit adjusts the correction value stored in the correction value storage unit.

9 Claims, 23 Drawing Sheets

OTHER PUBLICATIONS

C.A. Spindt, et al., "Physical Properties of Thin-Film Field Emission Cathodes with Molybdenum Cones", Journal of Applied Physics, vol. 47, No. 12, pp. 5248–5263 (Dec. 1976).

W.P. Dyke, et al., "Field Emission", Advances in Electronics and Electron Physics, vol. 8, pp. 90–185 (1956).

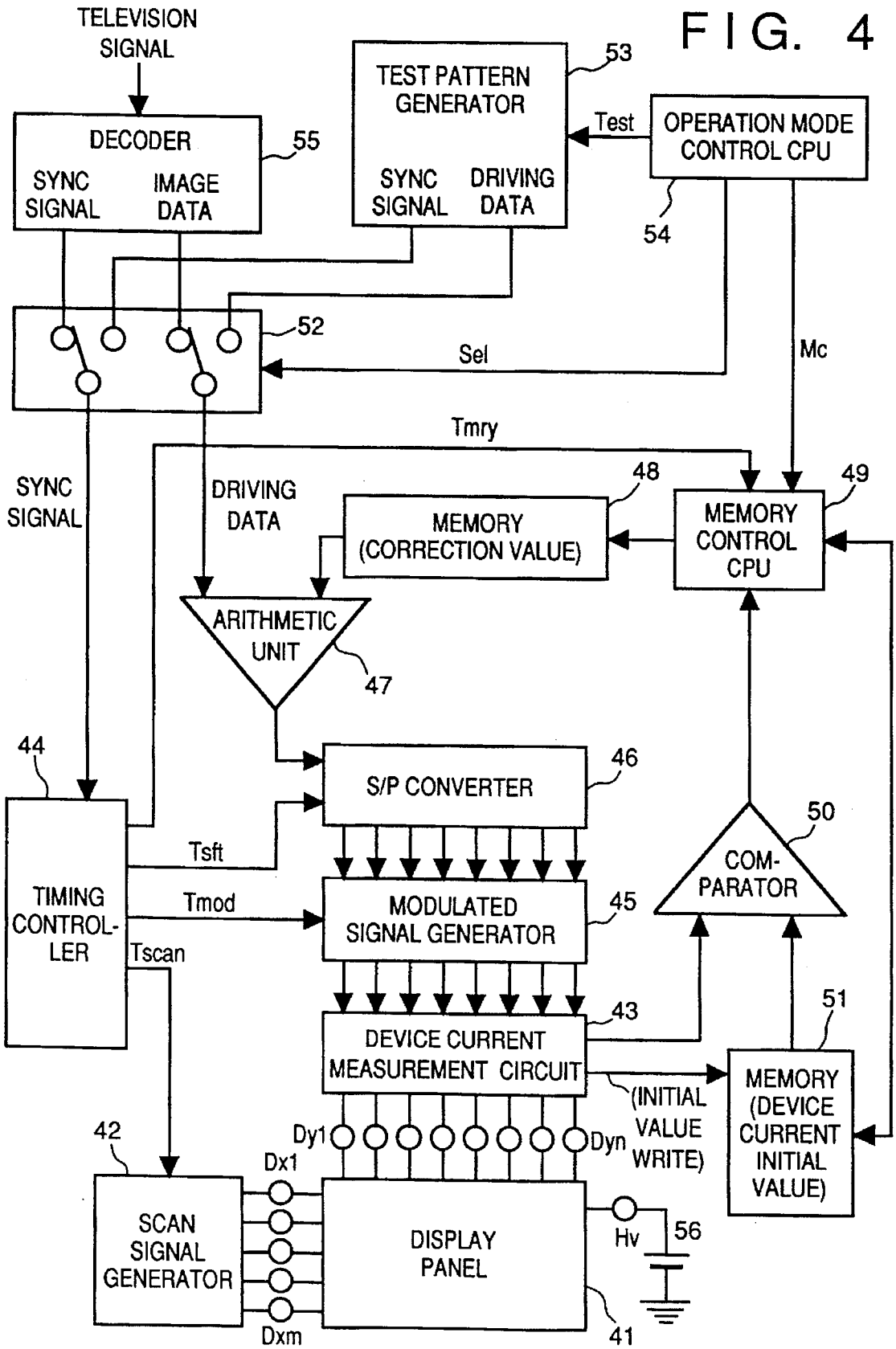
FIG. 4
TELEVISION SIGNAL
DECODER
SYNC SIGNAL
IMAGE DATA
55
TEST PATTERN GENERATOR
SYNC SIGNAL
DRIVING DATA
53
Test
OPERATION MODE CONTROL CPU
54
52
Sel
Mc
Tmry
SYNC SIGNAL
DRIVING DATA
48
MEMORY (CORRECTION VALUE)
49
MEMORY CONTROL CPU
ARITHMETIC UNIT
47
44
S/P CONVERTER
46
50
COM-PARATOR
Tsft
TIMING CONTROL-LER
Tmod
MODULATED SIGNAL GENERATOR
45
Tscan
43
51
DEVICE CURRENT MEASUREMENT CIRCUIT
(INITIAL VALUE WRITE)
MEMORY (DEVICE CURRENT INITIAL VALUE)
42
Dy1
Dyn
Dx1
SCAN SIGNAL GENERATOR
DISPLAY PANEL
Hv
56
Dxm
41

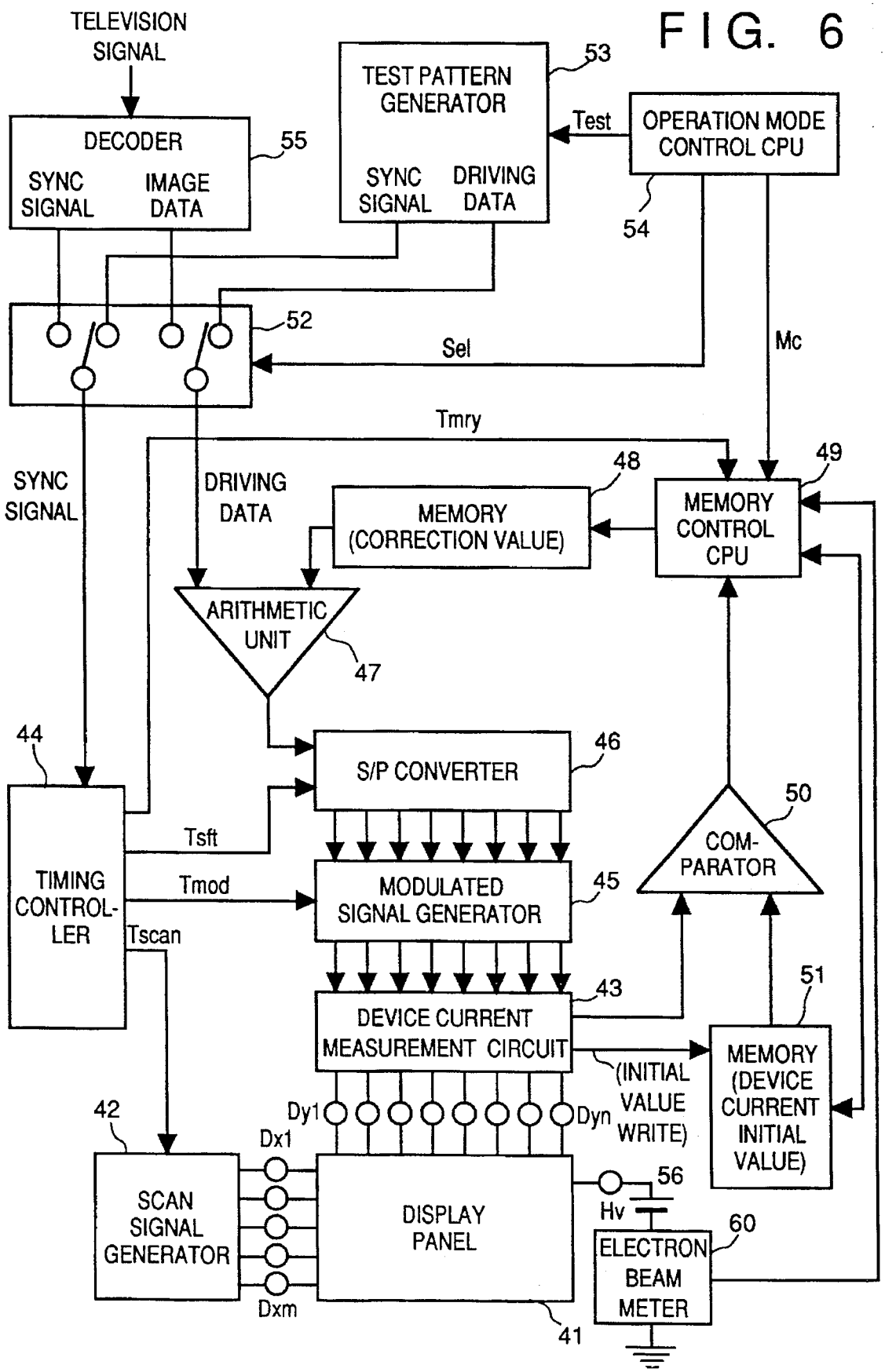
FIG. 6
TELEVISION SIGNAL
DECODER
SYNC SIGNAL
IMAGE DATA
55
TEST PATTERN GENERATOR
SYNC SIGNAL
DRIVING DATA
53
Test
OPERATION MODE CONTROL CPU
54
52
Sel
Mc
Tmry
SYNC SIGNAL
DRIVING DATA
48
MEMORY (CORRECTION VALUE)
49
MEMORY CONTROL CPU
ARITHMETIC UNIT
47
44
S/P CONVERTER
46
50
COM-PARATOR
Tsft
TIMING CONTROL-LER
Tmod
MODULATED SIGNAL GENERATOR
45
Tscan
43
51
DEVICE CURRENT MEASUREMENT CIRCUIT
(INITIAL VALUE WRITE)
MEMORY (DEVICE CURRENT INITIAL VALUE)
42
Dy1
Dyn
Dx1
SCAN SIGNAL GENERATOR
DISPLAY PANEL
56
Hv
60
ELECTRON BEAM METER
Dxm
41

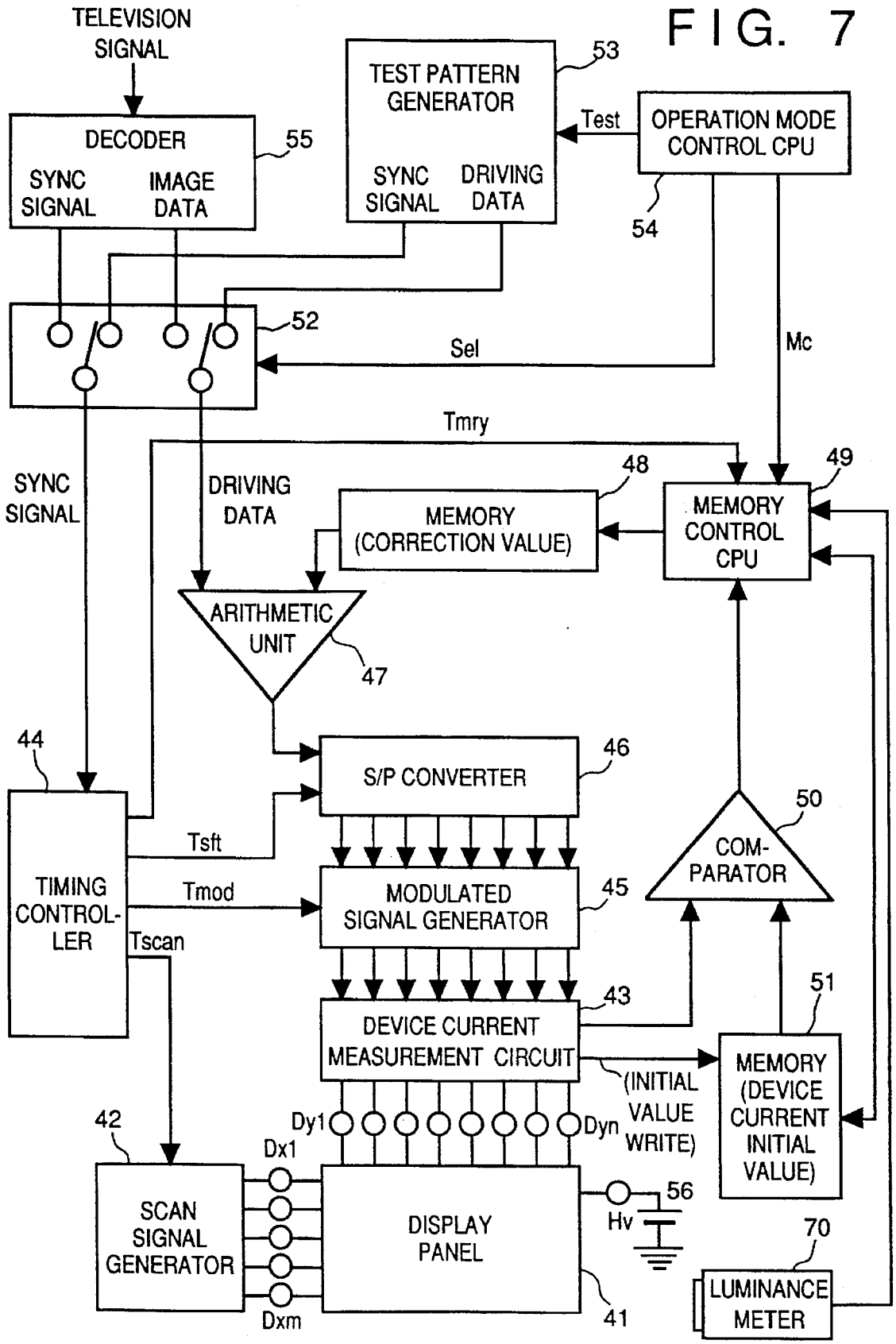
FIG. 7
TELEVISION SIGNAL
DECODER
SYNC SIGNAL
IMAGE DATA
55
TEST PATTERN GENERATOR
SYNC SIGNAL
DRIVING DATA
53
Test
OPERATION MODE CONTROL CPU
54
52
Sel
Mc
Tmry
SYNC SIGNAL
DRIVING DATA
48
MEMORY (CORRECTION VALUE)
49
MEMORY CONTROL CPU
ARITHMETIC UNIT
47
44
S/P CONVERTER
46
50
COM-PARATOR
Tsft
TIMING CONTROL-LER
Tmod
MODULATED SIGNAL GENERATOR
45
Tscan
43
51
DEVICE CURRENT MEASUREMENT CIRCUIT
(INITIAL VALUE WRITE)
MEMORY (DEVICE CURRENT INITIAL VALUE)
42
Dy1
Dyn
Dx1
SCAN SIGNAL GENERATOR
DISPLAY PANEL
56
Hv
70
LUMINANCE METER
Dxm
41

ELECTRON BEAM GENERATING APPARATUS, IMAGE DISPLAY APPARATUS, AND METHOD OF DRIVING THE APPARATUS

BACKGROUND OF THE INVENTION

1. Field of the Invention

The present invention relates to an electron beam generating apparatus including electron emission devices, an image display apparatus using this electron beam generating apparatus, and a method of driving these apparatuses.

2. Related Background Art

Thermionic cathodes and cold cathodes are conventionally known as electron emission devices. As cold cathodes, a field emission device (to be abbreviated as an FE device hereinafter), a metal/insulator/metal emission device (to be abbreviated as an MIM device hereinafter), and a surface conduction electron emitting device are known.

Known examples of the FE device are W. P. Dyke & W. W. Dolan, "Field emission", Advance in Electron Physics,. 8, 89 (1956) and C. A. Spindt, "Physical properties of thin-film field emission cathodes with molybdenium cones", J. Appl. Phys., 47, 5248 (1976).

One known example of the MIM device is C. A. Mead, "Operation of tunnel-emission devices", J. Appl. Phys., 32, 646 (1961).

As the surface conduction electron emitting device, M. I. Elinson, Radio Eng. Electron Phys., 10, 1290 (1965) and other devices to be described later are known.

The surface conduction electron emitting device uses a phenomenon in which electron emission is caused by flowing a current parallel to the surface of a thin film with a small area which is formed on a substrate. Among the surface conduction electron emitting devices that have been reported, in addition to the above-mentioned device by Elinson et al. which uses a thin $SnO_2$ film, are a device using a thin Au film [G. Dittmer: "Thin Solid Films", 9 317 (1972)], a device using a thin $In_2O_3/SnO_2$ film [M. Hartwell and C. G. Fonstad: "IEEE Trans ED Conf", 519 (1975)], and a device using a thin carbon film [Hisashi Araki et al.: Vacuum, Vol. 26, No. 1, 22 (1983)].

FIG. 23 is a plan view showing the device by M. Hartwell described above, as a typical example of the device structures of these surface conduction electron emitting devices. Referring to FIG. 23, reference numeral 3001 denotes a substrate; and 3004, a thin conductive film of a metal oxide formed by sputtering. As in FIG. 23, the thin conductive film 3004 is so formed as to have an H-like planar shape. On the thin conductive film 3004, an electron emission portion 3005 is formed by electro-processing called "energization forming" (to be described below). In FIG. 23, a distance L is set at 0.5 to 1 [mm], and W is set at 0.1 [mm]. Note that in FIG. 23, the electron emission portion 3005 is illustrated as a rectangular portion in the center of the thin conductive film 3004 for convenience, but this is merely a schematic illustration of that portion. That is, the position and shape of an actual electron emission portion are not precisely depicted in FIG. 23.

In the above surface conduction electron emitting devices represented by the device by M. Hartwell et al., it is the general approach to form the electron emission portion 3005 by performing electro-processing called energization forming for the thin conductive film 3004 prior to causing electron emission. The energization forming is the processing in which a constant DC voltage or a DC voltage which rises very slowly, e.g., at a rate of 1 V/min is applied across the thin conductive film 3004 to locally destroy, deform, or modify the thin conductive film 3004, thereby forming the electron emission portion 3005 in an electrically high-resistance state. Note that a fissure is formed in a portion of the thin conductive film 3004 which is locally destroyed, deformed, or modified. Electron emission is performed near this fissure upon application of an appropriate voltage to the thin conductive film 3004 after the energization forming.

The surface conduction electron emitting device described above is simple in structure and easy to fabricate. The result is that a large number of devices can be formed across a large area. For this reason, a method of driving an array of a number of these devices is being studied as disclosed in, e.g., Japanese Patent Laid-Open No. 64-31332 filed by the present applicant.

Also, for applications of the surface conduction electron emitting devices, studies have been made on, e.g., image forming apparatuses, such as image display apparatuses and image recording apparatuses, and charged beam sources. In particular, as an application of the surface conduction electron emitting device to an image display apparatus, an image display apparatus making use of a combination of the device and a phosphor which luminesces when irradiated with an electron beam is being studied, as disclosed in, e.g., U.S. Pat. No. 5,185,554 or Japanese Patent Laid-Open No. 2-257551 filed by the present applicant. These image display apparatuses using the combination of the surface conduction electron emitting device and a phosphor are expected to provide better characteristics than those obtained by conventional image display apparatuses of other types. For example, image display apparatuses of this type can be said to be superior to liquid crystal displays that have become popular in recent years, in that these apparatuses require no back light because they are of a self-luminescing type and have a wide viewing angle.

SUMMARY OF THE INVENTION

The present inventors have attempted fabrications of various surface conduction electron emitting devices of different material, fabrication method, and structure, including the conventional devices described above. Also, the present inventors have made extensive studies on a multiple electron beam source in which a large number of the surface conduction electron emitting devices are arranged, and on an image display apparatus to which this multiple electron beam source is applied.

As an example, the present inventors have tried a multiple electron beam source based on an electrical wiring method as illustrated in FIG. 22. In this multiple electron beam source, a number of surface conduction electron emitting devices are two-dimensionally arranged and connected in a matrix manner as depicted in FIG. 22.

In FIG. 22, reference numeral 4001 denotes surface conduction electron emitting devices illustrated schematically; 4002, row-direction lines; and 4003, column-direction lines. Actually, the row- and column-direction lines 4002 and 4003 have finite electrical resistances. In FIG. 22, these resistances are illustrated as line resistances 4004 and 4005. A wiring method of this sort is called simple matrix wiring.

Note that the 6×6 matrix is shown in FIG. 22 for illustrative convenience, but the scale of the matrix, of course, is not limited to this one. In the case of a multiple electron beam source for an image display apparatus, for instance, devices enough to perform a desired image display are arranged and connected.

In the multiple electron beam source in which the surface conduction electron emitting devices are connected by the simple matrix wiring, an appropriate electrical signal is applied on the row-direction lines 4002 and the column-direction lines 4003 to output desired electron beams. For example, to drive the surface conduction electron emitting devices in one given row of the matrix, a selection voltage Vs is applied to the row-direction line 4002 of the row to be selected, and at the same time a non-selection voltage Vns is applied to the row-direction lines 4002 of the rows not to be selected. In synchronism with these voltage applying operations, a drive voltage Ve for outputting an electron beam is applied to the column-direction lines 4003. In this method, neglecting the voltage drops caused by the line resistances 4004 and 4005, a voltage of Ve–Vs is applied to the surface conduction electron emitting devices in the selected row, and a voltage of Ve–Vs is applied to those in the non-selected rows. Expected results are that electron beams of a desired intensity are output only from the surface conduction electron emitting devices in the selected row if Ve, Vs, and Vns are set to their respective appropriate voltages, and that electron beams of each different intensity are output from the devices in the selected row if different drive voltages Ve are applied to the individual column-direction lines. Additionally, since the response speed of the surface conduction electron emitting device is high, it is also expected that the time period during which electron beams are output can be altered by changing the length of the application time of the drive voltage Ve.

Therefore, various applications are possible for the multiple electron beam source manufactured by connecting the surface conduction electron emitting devices by the simple matrix wiring. As an example, the multiple electron beam source of this type can be preferably used as an electron source of an image display apparatus by applying a proper electrical signal corresponding to image information.

Image display apparatuses using the multiple electron beam source in which the surface conduction electron emitting devices are connected by the simple matrix wiring, however, are found to have the following problems.

That is, when applied to television or computer terminals, for example, image display apparatuses are required to have characteristics such as a high definition, a large display screen, a large number of pixels, and a long service life. To realize these characteristics, the multiple electron beam source must have a very-large-scale simple matrix in which up to several hundred to several thousand rows-columns are arranged. In addition, it is desirable that the electron emission characteristics of the individual surface conduction electron emitting devices be uniform and this uniformity be maintained for a long period of time.

The large-scale multiple electron beam source as described above, however, has the problem that manufacturing variations take place in the electron emission characteristics of the surface conduction electron emitting devices.

The manufacturing variations occur when errors are produced due to some causes related to, e.g., the size, shape, or material composition in the film formation step or in the patterning step for forming the electrodes or the conductive films of individual surface conduction electron emitting devices.

In addition, when the multiple electron beam source manufactured by the simple matrix wiring is used for a long time period, the electron emission characteristics of the surface conduction electron emitting devices change, and it is unfortunate that the degree of this change differs from one device to another for the following reason. That is, when the multiple electron beam source is applied to an image display apparatus, the individual surface conduction electron emitting devices are driven in accordance with an image to be displayed. As a consequence, the total driving time varies from one device to another. It is considered this for that reason each surface conduction electron emitting devices changes to a different extent with time.

If the surface conduction electron emitting devices have manufacturing variations in their device characteristics or have nonuniform changes with time as described above, variations are caused in the intensities of electron beams emitted from the multiple electron beam source, resulting in variations in the luminance or disturbance in the color balance of displayed images. As a consequence, the quality of the displayed images is degraded.

The present invention has been made in consideration of the above conventional problems and has its object to correct variations in output from a multiple electron beam source caused by manufacturing variations in characteristics or by nonuniform changes with time, thereby preventing degradation in the quality of displayed images.

The basic idea of the present invention is to measure and store variations in the initial characteristics of individual surface conduction electron emitting devices beforehand, and correct the driving conditions for each surface conduction electron emitting device on the basis of the stored contents. In addition, the idea of the present invention is to detect the change with time of each surface conduction electron emitting device and adjust the correction amount for the driving conditions of each device in accordance with the change with time thus detected, by making use of the characteristic inherent in the surface conduction electron emitting device. The inherent characteristic of the surface conduction electron emitting device herein mentioned is a close correlation to a current (to be referred to as a device current hereinafter) flowing through a device and the intensity of an electron beam emitted from the device. Therefore, the change in the electron beam output characteristic with time can be detected by measuring the change in the device current with time.

According to the first aspect of the present invention, there is an electron beam generating apparatus for an electron beam source including surface conduction electron emitting devices formed on a substrate, comprising measuring means for measuring a device current flowing through each of the surface conduction electron emitting devices, device current storage means for storing data measured by the measuring means, comparing means for comparing latest data measured by the measuring means with the data stored in the device current storage means, correction value storage means for storing a correction value for correcting a driving signal to be applied to each surface conduction electron emitting device, and adjusting means for adjusting the correction value stored in the correction value storage means.

According to the second aspect of the present invention, there is an electron beam generating apparatus according to the first aspect, wherein the measuring means measures the device current by applying a voltage lower than an electron emission threshold voltage of the surface conduction electron emitting devices.

According to the third aspect of the present invention, there is an electron beam generating apparatus according to the first aspect, wherein the surface conduction electron emitting devices are connected in a matrix manner by row-direction lines and column-direction lines, the driving signal to be applied to the surface conduction electron emitting devices consists of a scan signal applied from the row-direction lines and a modulated signal applied from the column-direction lines, and the modulated signal is corrected by the correction value stored in the correction value storage means.

According to the fourth aspect of the present invention, there is an image display apparatus including surface conduction electron emitting devices formed on a substrate and a phosphor which emits visible light when irradiated with an electron beam, comprising measuring means for measuring a device current flowing through each of the surface conduction electron emitting devices, device current storage means for storing data measured by the measuring means, comparing means for comparing latest data measured by the measuring means with the data stored in the device current storage means, correction value storage means for storing a correction value for correcting a driving signal to be applied to each surface conduction electron emitting device, and adjusting means for adjusting the correction value stored in the correction value storage means.

According to the fifth aspect of the present invention, there is an image display apparatus according to the fourth aspect, wherein the measuring means measures the device current by applying a voltage lower than an electron emission threshold voltage of the surface conduction electron emitting devices.

According to the sixth aspect of the present invention, there is an image display apparatus according to the fourth aspect, wherein the surface conduction electron emitting devices are connected in a matrix manner by row-direction lines and column-direction lines, the driving signal to be applied to the surface conduction electron emitting devices consists of a scan Signal applied from the row-direction lines and a modulated signal applied from the column-direction lines, and the modulated signal is corrected by the correction value stored in the correction value storage means.

According to the seventh aspect of the present invention, there is a method of driving an image display apparatus including surface conduction electron emitting devices formed on a substrate, a phosphor which emits visible light when irradiated with an electron beam, measuring means for measuring a device current flowing through each of the surface conduction electron emitting devices, device current storage means for storing data measured by the measuring means, comparing means for comparing latest data measured by the measuring means with the data stored in the device current storage means, correction value storage means for storing a correction value for correcting a driving signal to be applied to each surface conduction electron emitting device, and adjusting means for adjusting the correction value stored in the correction value storage means, comprising the steps of causing the device current storage means to store measured values of device currents in initial stages after fabrication of the surface conduction electron emitting devices, causing the correction value storage means to store, as an initial value, a correction value determined on the basis of the measured value of the initial device current of each surface conduction electron emitting device, causing the device current measuring means to measure the device current after an image is displayed for an arbitrary time period, causing the comparing means to compare latest data measured by the device current measuring means after driving for the arbitrary time period with the data stored in the device current storage means, and causing the adjusting means to adjust the correction value stored in the correction value storage means if the comparison result exceeds a predetermined range.

According to the eighth aspect of the present invention, there is a method of driving an image display apparatus including surface conduction electron emitting devices formed on a substrate, a phosphor which emits visible light when irradiated with an electron beam, measuring means for measuring a device current flowing through each of the surface conduction electron emitting devices, device current storage means for storing data measured by the measuring means, comparing means for comparing latest data measured by the measuring means with the data stored in the device current storage means, correction value storage means for storing a correction value for correcting a driving signal to be applied to each surface conduction electron emitting device, and adjusting means for adjusting the correction value stored in the correction value storage means, comprising the steps of causing the device current storage means to store measured values of device currents in initial stages after fabrication of the surface conduction electron emitting devices, causing the correction value storage means to store, as an initial value, a correction value determined on the basis of a measured value of an initial electron beam (emission current) of each surface conduction electron emitting device, causing the device current measuring means to measure the devices current after an image is displayed for an arbitrary time period, causing the comparing means to compare latest data measured by the device current measuring means after driving for the arbitrary time period with the data stored in the device current storage means, and causing the adjusting means to adjust the correction value stored in the correction value storage means if the comparison result exceeds a predetermined range.

According to the ninth aspect of the present invention, there is a method of driving an image display apparatus including surface conduction electron emitting devices formed on a substrate, a phosphor which emits visible light when irradiated with an electron beam, measuring means for measuring a device current flowing through each of the surface conduction electron emitting devices, device current storage means for storing data measured by the measuring means, comparing means for comparing latest data measured by the measuring means with the data stored in the device current storage means, correction value storage means for storing a correction value for correcting a driving signal to be applied to each surface conduction electron emitting device, and adjusting means for adjusting the correction value stored in the correction value storage means, comprising the steps of causing the device current storage means to store measured values of device currents in initial stages after fabrication of the surface conduction electron emitting devices, causing the correction value storage means to store, as an initial value, a correction value determined on the basis of a measured value of luminance obtained when each surface conduction electron emitting device emits an electron beam onto the phosphor, causing the device current measuring means to measure the device current after an image is displayed for an arbitrary time period, causing the comparing means to compare latest data measured by the device current measuring means after driving for the arbitrary time period with the data stored in the device current storage means, and causing the adjusting means to adjust the correction value stored in the correction value storage means if the comparison result exceeds a predetermined range.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

FIG. 4 is a circuit block diagram of an image display apparatus of the second embodiment;

FIG. 6 is a circuit block diagram for determining the correction value (initial value) for driving conditions by measuring an emission current;

FIG. 7 is a circuit block diagram for determining the correction value (initial value) for driving conditions by measuring luminance;

DETAILED DESCRIPTION OF THE PREFERRED EMBODIMENTS

Preferred embodiments of an electron beam generating apparatus, an image display apparatus, and a method of driving these apparatuses will be described below.

Note that for descriptive convenience, the structures, fabrication methods, and characteristics of preferred surface conduction electron emitting devices and the structure and manufacturing method of the display panel of a preferred image display apparatus will be described in detail after the first and second embodiments are explained.

(1st Embodiment)

Figure 2:
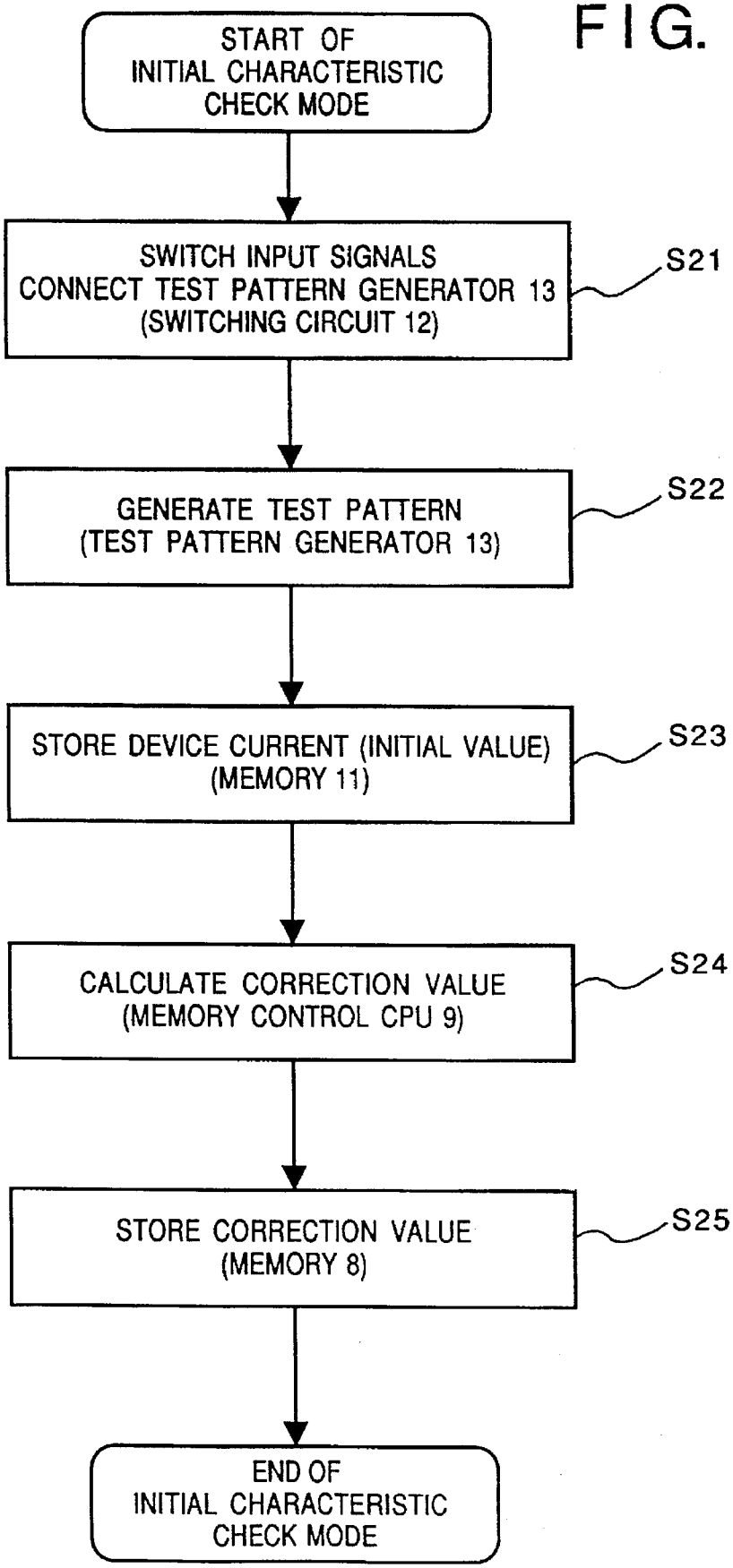
FIG. 2 is a flow chart showing the operation procedure in an initial characteristic check mode in the first embodiment.
Figure 3:
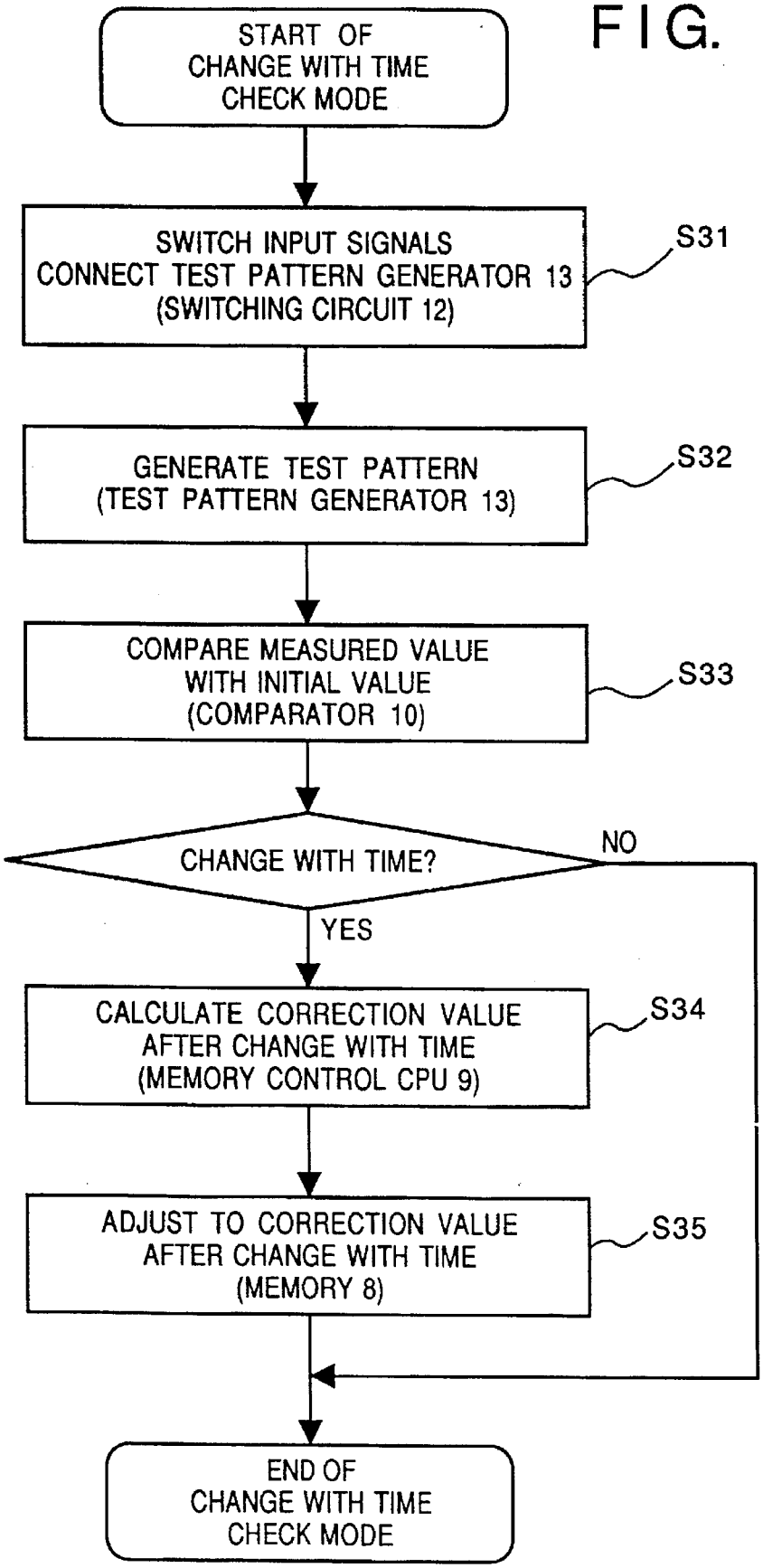
FIG. 3 is a flow chart showing the operation procedure in a characteristic change check mode in the first embodiment.

An embodiment of an electron beam generating apparatus according to the present invention will be described below with reference to FIGS. 1 to 3.

Figure 1:
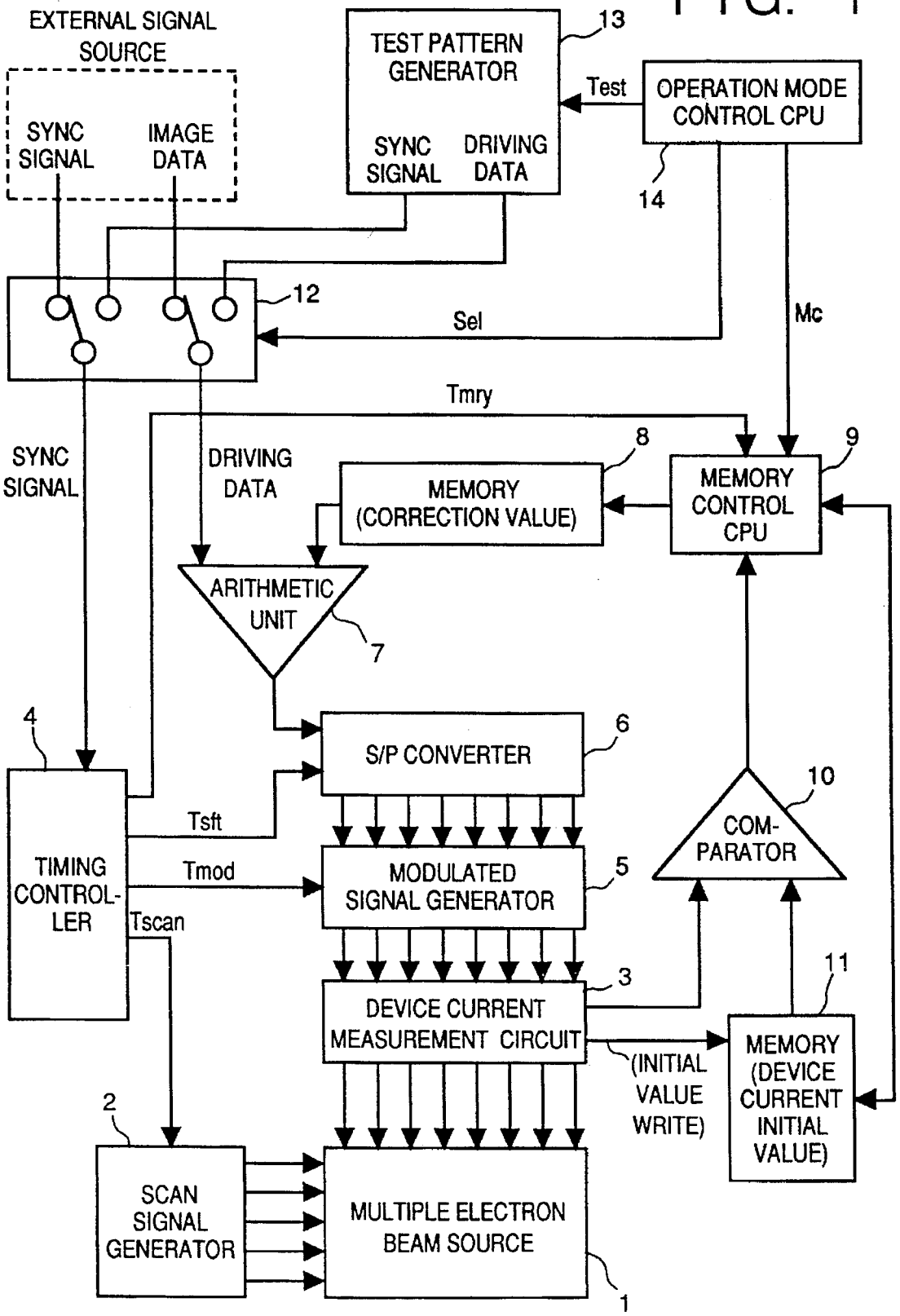
FIG. 1 is a circuit block diagram of an electron beam generating apparatus of the first embodiment.

FIG. 1 is a circuit block diagram showing the arrangement of the electron beam generating apparatus. In FIG. 1, reference numeral 1 denotes a multiple electron beam source; 2, a scan signal generator; 3, a device current measurement circuit; 4, a timing controller; 5, a modulated signal generator; 6, a serials/parallel converter; 7, an arithmetic unit; 8, a memory storing correction values; 9, a memory control CPU; 10, a comparator;.11, a memory storing initial values of device currents; 12, a switching circuit; 13, a test pattern generator; and 14, an operation mode control CPU.

In the multiple electron beam source 1, a large number of surface conduction electron emitting devices are formed on a substrate and connected in a matrix manner by row- and column-direction lines. Details of the structure of the multiple electron beam source 1 will be described later with reference to FIGS. 19 and 20.

The scan signal generator 2 and the modulated signal generator 5 are circuits for driving the multiple electron beam source 1. An output from the scan signal generator 2 is applied to the row-direction lines of the multiple electron beam source 1. An output from the modulated signal generator 5 is applied to the column-direction lines of the multiple electron beam source 1. The scan signal generator 2 sequentially selects rows to be driven from the rows of a large number of the surface conduction electron emitting devices formed in a matrix manner. The modulated signal generator 5 modulates an electron beam emitted from each surface conduction electron emitting device. The modulation scheme is, e.g., pulse-width modulation or voltage-amplitude modulation.

The device current measurement circuit 3 measures the current (device current) flowing through each surface conduction electron emitting device of the multiple electron beam source 1.

The timing controller 4 generates a timing control signal for matching the operation timings of individual circuits.

The serial/parallel converter 6 converts serially input driving data (after correction) into parallel data line by line.

The arithmetic unit 7 corrects externally input driving data on the basis of the correction values stored in the memory 8.

The memory 8 stores the correction values for driving conditions of the individual surface conduction electron emitting devices of the multiple electron beam source 1. These correction values are determined on the basis of variations in the characteristics of the surface conduction electron emitting devices.

The memory 11 stores the device currents (initial values) of the individual surface conduction electron emitting devices of the multiple electron beam source 1 in the initial stages after the fabrication.

The memory control CPU 9 controls write and read operations of the correction values to the memory 8 and controls write and read operations of the device currents (initial values) to the memory 11.

The comparator 10 compares the latest device current measured by the device current measurement circuit 3 with the device current (initial value) stored in the memory 11. The test pattern generator 13 is a signal generator for generating a check driving signal for checking the characteristic of each surface conduction electron emitting device of the multiple electron beam source. 1.

The switching circuit 12 selects either a driving signal supplied from an external signal source or the check driving signal generated by the test pattern generator 13. The operation mode control CPU 14 controls the operation modes Of the apparatus. More specifically, the operation mode control CPU 14 operates the apparatus by selecting an appropriate one of three types of operation modes, i.e., an initial characteristic check mode, a normal drive mode, and a characteristic change check mode.

The operations-of the apparatus illustrated in FIG. 1 will be described below. The apparatus operates in the above three types of operation modes, i.e., the initial characteristic check mode, the normal drive mode, and the characteristic change check mode, so these operation modes will be described in the order named.

Initial Characteristic Check Mode

The initial characteristic check mode is an operation mode in which the initial characteristic of each surface conduction electron emitting device of the multiple electron beam source 1 after the fabrication is checked and stored, and a driving correction value corresponding to the characteristic of each device is determined and stored. More specifically, the device current (initial value) of each surface conduction electron emitting device is measured by the device current measurement circuit 3 and stored in the memory 11. In addition, the driving correction value for each surface conduction electron emitting device is determined on the basis of the measurement result and stored in the memory 8.

The operation procedure will be described below with reference to the flow chart in FIG. 2.

(S21): First, the internal switches of the switching circuit 12 are closed to the positions on the test pattern generator 13 side. More specifically, the operation mode control CPU 14 performs this step by outputting a control signal Se1 to the switching circuit 12.

(S22): Subsequently, the test pattern generator 13 outputs a driving signal for the check. This step is started when the operation mode control CPU 14 outputs a control signal Test to the test pattern generator 13.

(S23): The device current is then measured and stored in the memory 11. In this step, the operation mode control CPU 14 outputs to the memory control CPU 9 an instruction Mc indicating write access to the memory 11. The write access to the memory 11 is done under the control of the memory control CPU 9.

More specifically, the timing controller 4 generates various timing control signals on the basis of a output sync signal from the test pattern generator 13, thereby adjusting the operation timings of the S/P converter 6, the modulated signal generator 5, the scan signal generator 2, and the memory control CPU 9. The check driving data output from the test pattern generator 13 is input to the arithmetic unit 7.

In this stage, however, no correction value is set in the memory 8. Therefore, the driving data is directly applied to the S/P converter 6. On the basis of the check driving data converted into parallel data by the S/P converter 6, the modulated signal generator 5 output a modulated signal. Simultaneously, the device current measurement circuit 3 measures the device current flowing through each surface conduction electron emitting device. Each measurement result is stored in the memory 11 as the device current (initial value).

(S24): Subsequently, the memory control CPU 9 reads out the device current (initial value) from the memory 11 and calculates the correction value for driving conditions on the basis of the readout value. In this step, the operation mode control CPU 14 outputs to the memory control CPU 9 the instruction Mc indicating the calculation of the correction value for driving conditions.

Various calculation methods are usable in calculating the driving condition correction value. One preferred method is to divide a predetermined design value by the measured value read out from the memory 11. That is, when the design value of the device current is 3.3 [mA] and the measured value of a certain surface conduction electron emitting device is, 3.0 [mA], the correction value calculated is 1.1.

(S25): The driving condition correction values calculated in (S24) are stored in the memory 8. The operation mode control CPU 14 performs this step by outputting to the memory control CPU 9 the instruction Mc indicating storage of the correction values into the memory 8.

The initial characteristic check mode is executed following the operation procedure described above.

Normal Drive Mode

The normal drive mode will be described next. In this mode the multiple electron beam source 1 is driven to output electron beams by driving data supplied from the external signal source. The operation procedure of this mode will be described below.

In this mode, the internal switches of the switching circuit 12 are connected to the external signal source. Generally, the external signal source separately supplies the driving data and the sync signal. If the driving data and the sync signal are supplied in a composite signal form, the signal can be separated by a decoder (not shown) before processing.

The timing controller 4 generates various timing control signals on the basis of the sync signal supplied from the external signal source, thereby adjusting the operation timings of the S/P converter 6, the modulated signal generator 5, the scan signal generator 2, and the memory control CPU 9. More specifically, the timing controller 4 outputs, to the S/P converter 6 a clock signal Tsft for converting the driving data of one line into parallel data, to the modulated signal generator 5 a control signal Tmod for controlling the modulated signal generation timing, to the scan signal generator 2 a control signal Tscan for performing a line-sequential scan, and to the memory control CPU 9 a control signal Tmry for adjusting the timing at which the correction value is read out from the memory 8.

The driving data supplied from the external signal source is input to the arithmetic unit 7, and the arithmetic unit 7 corrects the data by using the correction value read out from the memory 8. (Needless to say, the correction value related to the surface conduction electron emitting device at the position corresponding to the driving data is read out under the control of the memory control CPU 9.) Various calculation methods are possible as the correction method. One preferred method is to multiply the driving data by the correction value. The corrected driving data is applied to the S/P converter 6. On the basis of the driving data converted into parallel data by the S/P converter 6, the modulated signal generator 5 outputs modulated signals of one line simultaneously. In synchronism with this output, the scan signal generator 2 outputs a scan signal for selecting the line to be driven.

By a series of the above operations, the multiple electron beam source 1 outputs electron beams in accordance with the driving data. Since the driving signals applied to the surface conduction electron emitting devices are already corrected on the basis of the respective characteristics of the devices, electron beams can be output faithfully with respect to the driving data supplied from the external signal source.

The normal drive mode is executed following the procedure described above. Note that in this mode, none of the memory 11, the comparator 10, and the test pattern generator 13 need be operated.

Characteristic Change Check Mode

The characteristic change check mode will be described below. In this mode, a change with time in the electron emission characteristic of each surface conduction electron emitting device is checked, and the correction value for driving conditions stored in the memory 8 is adjusted 0n the basis of the check result where necessary. More specifically, whether a change with time occurs is checked for each device by comparing the latest result measured by the device current measurement circuit 3 with the device current (initial value) stored in the memory 11.

The operation procedure will be described below with reference to the flow chart in FIG. 3.

(S31): First, the internal switches of the switching circuit 12 are set to the positions on the test pattern generator 13 side. More specifically, the operation mode control CPU 14 performs this step by outputting the control signal Se1 to the switching circuit 12.

(S32): Subsequently, the test pattern generator 13 generates a driving signal for the check. This step is started when the operation mode control CPU 14 outputs the control signal Test to the test pattern generator 13.

(S33): The measured value and the initial value are compared.

To begin with, the device current is measured by the device current measurement circuit 3 and output to the comparator 10. More specifically, in this step, the timing controller 4 generates various timing control signals on the basis of the output sync signal from the test pattern generator 13, thereby adjusting the operation timings of the S/P converter 6, the modulated signal generator 5, the scan signal generator 2, and the memory control CPU 9. The output check driving data from the test pattern generator 13 is input to the arithmetic unit 7. Since in this stage, the memory control CPU 9 performs control such that no correction value is read out from the memory 8, the driving data is directly input to the S/P converter 6. On the basis of the check driving data converted into parallel data by the S/P converter 6, the modulated signal generator 5 generates a modulated signal. Simultaneously, the device current measurement circuit 3 measures the device current flowing through each surface conduction electron emitting device.

At the same time, the device current (initial value) is read out from the memory 11 and output to the comparator 10. In this stage, the operation mode control CPU 14 outputs to the memory control CPU 9 the instruction Mc indicating a read from the memory 11. Consequently, the read access to the memory 11 is done under the control of the memory control CPU 9.

The comparator 10 compares the measured value with the initial value. If it is determined that there is no change with time, the characteristic change check mode is ended. On the other hand, if it is determined that a change with time has taken place, the flow advances to (S34). Various methods can be used to determine the presence/absence of a change with time. Preferred examples are a method in which a change with time is detected if the difference between the measured value and the initial value exceeds a predetermined range, and a method in which a change with time is detected if a ratio of the measured value to the initial value exceeds a certain range. In this embodiment, the former method is employed, and it is determined that a change with time has occurred if the difference between the measured value and the initial value exceeds 0.1 [mA].

(S34): For the surface conduction electron emitting device found to have a change with time, the memory control CPU 9 calculates the correction value for driving conditions after the change with time. Various calculation methods are usable in calculating the driving condition correction value. One preferred method is to divide a predetermined design value by the measured value after the change with time. That is, if the measured value after the change with time of a surface conduction electron emitting, device whose design value of the device current was 3.3 [mA] is 2.7 [mA], the correction value calculated is approximately 1.2.

(S35): Subsequently, the driving condition correction value for the device having the change with time is adjusted. That is, the content of the memory 8 is rewritten by the driving condition correction value calculated in (S34) after the change with time has taken place.

The characteristic change check mode is executed following the above-mentioned procedure.

The contents of the three operation modes of the electron beam generating apparatus in FIG. 1 are explained above. The timings at which these operation modes are executed will be described below.

When the electron beam generating apparatus is manufactured, the initial characteristic check mode is first executed. Thereafter the apparatus is operated in the normal drive mode, and the characteristic change check mode is executed at appropriate intervals by the instruction from the operation mode control CPU 14. One desirable method is the one in which the operation time in the normal drive mode is accumulated, and the characteristic change check mode is executed whenever a predetermined time (e.g., 100 hours) has elapsed. In some cases, it is also possible to execute the characteristic change check mode each time the power supply of the electron beam generating apparatus is turned on or off.

The electron beam generating apparatus as one embodiment of the present invention has been described above.

Note that a desirable check voltage used in measuring the device current in the initial characteristic check mode and in the characteristic change check mode will be explained later when the characteristics of the surface conduction electron emitting device are described.

In the above embodiment, the memory 11 is used as read-only memory after the initial values of the device currents are written in the initial characteristic check mode. However, depending on the situation, the latest device current measured values can also be written in the memory 11 after the characteristic change check mode is executed. In these instances, it is possible to check whether another change with time has occurred after the characteristic change check mode is executed the last time and before it is executed this time. According to the idea of the present invention, the point is that it is only necessary to be able to detect a change in the electron emission characteristic of the surface conduction electron emitting device by detecting a change in the device current of the device, thereby properly correcting the driving conditions of the device.

(2nd Embodiment)

An embodiment of an image display apparatus according to the present invention will be described below with reference to FIGS. 4 to 8.

FIG. 4 is a circuit block diagram showing the arrangement of the image display apparatus. In FIG. 4, reference numeral 41 denotes a display panel; 42, a scan signal generator;. 43, a device current measurement circuit; 44, a timing controller; 45, a modulated signal generator; 46, a serial/parallel converter; 47, an arithmetic unit; 48, a memory storing correction values; 49, a memory control CPU; 50, a comparator; 51, a memory storing the initial values of device currents; 52, a switching circuit; 53, a test pattern generator; 54, an operation mode control CPU; 55, a decoder; and 56; a voltage source.

The display panel 41 includes a multiple electron beam source and a phosphor. In the multiple electron beam source, a large number of surface conduction electron emitting devices are formed on a substrate and connected in a matrix manner by row-direction lines and column-direction lines. The phosphor emits visible light when irradiated with electron beams. Details of the structure of the display panel 41 will be described later with reference to FIG. 10.

The scan signal generator 42 and the modulated signal generator 45 are circuits for driving the multiple electron beam source incorporated in the display panel 41. An output from the scan signal generator 42 is applied to the row-direction lines of the multiple electron beam source. An output from the modulated signal generator 45 is applied to the column-direction lines of the multiple electron beam source. The scan signal generator 42 sequentially selects rows to be driven from the rows of a number of the surface conduction electron emitting devices formed in a matrix manner. The modulated signal generator 45 modulates an electron beam emitted from each surface conduction electron emitting device. The modulation scheme is, e.g., pulse-width modulation or voltage-amplitude modulation.

The device current measurement circuit 43 measures the current (device current) flowing through each surface conduction electron emitting device of the multiple electron beam source.

The timing controller 44 generates a timing control signal for matching the operation timings of individual circuits.

The serial/parallel converter 46 converts serially input driving data (after correction) into parallel data line by line.

The arithmetic unit 47 corrects externally input driving data on the basis of the correction values stored in the memory 48.

The memory 48 stores the correction values for driving conditions of the individual surface conduction electron emitting devices of the multiple electron beam source incorporated in the display panel 41. These correction values are determined on the basis of variations in the characteristics of the surface conduction electron emitting devices.

The memory 51 stores the device currents (initial values) of the individual surface conduction electron emitting devices of the multiple electron beam source of the display panel 41 in the initial stages after the fabrication.

The memory control CPU 49 controls write and read operations of the correction values to the memory 48 and controls write and read operations of the device currents (initial values) to the memory 51.

The comparator 50 compares the latest device current measured by the device current measurement circuit 43 with the device current (initial value) stored in the memory 51.

The test pattern generator 53 is a signal generator for generating a check driving signal for checking the characteristic of each surface conduction electron emitting device of the multiple electron beam source of the display panel 41.

The switching circuit 52 selects either a driving signal supplied from the decoder 55 or the check driving signal generated by the test pattern generator 53.

The operation mode control CPU 54 controls the operation modes of the apparatus. More specifically, the operation mode control CPU 54 operates the apparatus by selecting one of three types of operation modes, i.e., an initial characteristic check mode, a normal drive mode, and a characteristic change check mode.

The decoder 55 decodes an externally supplied image signal into a sync signal and image data.

The voltage source 56 is electrically connected to the phosphor incorporated in the display panel 41 via a terminal Hv. The voltage source 56 outputs a DC voltage of, e.g., 5 [kV] to permit the phosphor to luminesce with a sufficient luminance.

The operations of the apparatus illustrated in FIG. 4 will be described below. The apparatus operates in the above three types of operation modes, i.e., the initial characteristic check mode, the normal drive mode, and the characteristic change check mode, so these operation modes will be described in the order named.

Initial Characteristic Check Mode

The initial characteristic check mode is an operation mode in which the initial characteristic of each surface conduction electron emitting device of the multiple electron beam source of the display panel 41 after the fabrication is checked and stored, and a driving correction value corresponding to the characteristic of each device is determined and stored. More specifically, the device current (initial value) of each surface conduction electron emitting device is measured by the device current measurement circuit 43 and stored in the memory 51. In addition, the driving correction value for each surface conduction electron emitting device is determined on the basis of the measurement result and stored in the memory 48.

Figure 5:
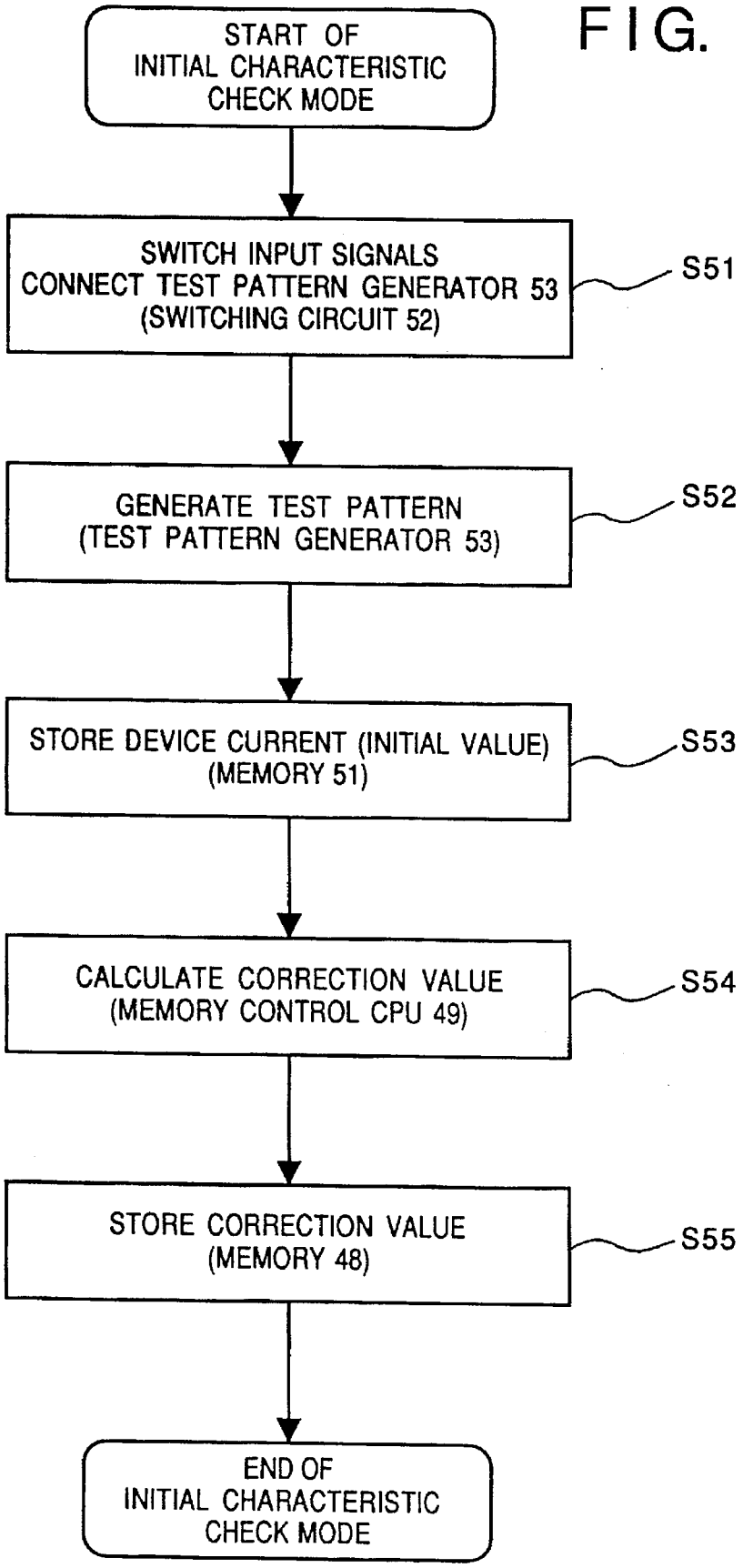
FIG. 5 is a flow chart showing the operation procedure in an initial characteristic check mode in the second embodiment.

The operation procedure will be described below with reference to the flow chart in FIG 5.

(S51): First, the internal switches of the switching circuit 52 are closed to the positions on the test pattern generator 53 side. More specifically, the operation mode control CPU 54 performs this step by outputting a control signal Se1 to the switching circuit 52.

(S52): Subsequently, the test pattern generator 53 outputs a driving signal for check. This step is started when the operation mode control CPU 54 outputs a control signal Test to the test pattern generator 53.

(S53): The device current is then measured and stored in the memory 51. In this step, the operation mode control CPU 54 outputs to the memory control CPU 49 an instruction Mc indicating write access to the memory 51. The write access to the memory 51 is done under the control of the memory control CPU 49.

More specifically, the timing controller 44 generates various timing control signals on the basis of an output sync signal from the test pattern generator 53, thereby adjusting the operation timings of the S/P converter 46, the modulated signal generator 45, the scan signal generator 42, and the memory control CPU 49. The check driving data output from the test pattern generator 53 is input to the arithmetic unit 47. In this stage, however, no correction value is set in the memory 48. Therefore, the driving data is directly applied to the S/P converter 46. On the basis of the check driving data converted into parallel data by the S/P converter 46, the modulated signal generator 45 outputs a modulated signal. Simultaneously, the device current measurement circuit 43 measures the device current flowing through each surface conduction electron emitting device. Each measurement result is stored in the memory 51 as the device current (initial value).

(S54): Subsequently, the memory control CPU 49 reads out the device current (initial value) from the memory 51 and calculates the correction value for driving conditions on the basis of the readout value. In this step, the operation mode control CPU 54 outputs to the memory control CPU 49 the instruction. Mc indicating the calculation of the correction value for driving conditions.

Various calculation methods are usable in calculating the driving condition correction value. One preferred method is to divide a predetermined design value by the measured value read out from the memory 51. That is, when the design value of the device current is 3.3 [mA] and the measured value of a certain surface conduction electron emitting device is 3.0 [mA], the correction value calculated is 1.1.

(S55): The driving condition correction values calculated in (S54) are stored in the memory 48. The operation mode control CPU 54 performs this step by outputting to the memory control CPU 49 the instruction Mc indicating storage of the correction values into the memory 48.

The initial characteristic check mode is executed following the operation procedure described above.

Note that in (S54) of this embodiment, the driving condition correction value for each surface conduction electron emitting device is calculated on the basis of the measured value of the device current (initial value). However, other calculation methods are also possible.

For example, as shown in FIG. 6, an electron beam meter 60 in series with the voltage source 56 can be connected to the memory control CPU 49. In this arrangement, the correction value for the driving conditions can be calculated on the basis of the measured value of the emission current (initial value) of each surface conduction electron emitting device.

Alternatively, as illustrated in FIG. 7, a luminance meter 70 for measuring the luminance of each pixel of the display panel can be connected to the memory control CPU 49. In this case, it is possible to calculate the correction value for the driving conditions on the basis of the luminance (initial value) of the phosphor.

The point is that it is only necessary to be able to either directly or indirectly measure the initial electron emission characteristic of each surface conduction electron emitting device and to calculate the driving condition correction value on the basis of the measurement result.

Normal Drive Mode

The normal drive mode will be described next. In this mode the display panel 41 is driven to perform an image display by an image signal such as a television signal supplied from the external signal source. The operation procedure of this mode will be described below.

In this mode, the internal switches of the switching circuit 52 are connected to the positions on the decoder 55 side. A composite signal such as a television signal is decoded to be separated into a sync signal and image data by the decoder 55.

The timing controller 44 generates various timing control signals on the basis of the sync signal supplied from the decoder 55, thereby adjusting the operation timings of the S/P converter 46, the modulated signal generator 45, the scan signal generator 42, and the memory control CPU 49. More specifically, the timing controller 44 outputs to the S/P converter 46 a clock signal Tsft for converting the driving data of one line into parallel data, to the modulated signal generator 45 a control signal Tmod for controlling the modulated signal generation timing, to the scan signal generator 42 a control signal Tscan for performing a line-sequential scan, and to the memory control CPU 49 a control signal Tmry for adjusting the timing at which the correction value is read out from the memory 48.

The image data supplied from the decoder 55 is input to the arithmetic unit 47, and the arithmetic unit 47 corrects the data by using the correction value read out from the memory 48. The correction value related to the surface conduction electron emitting device at the position corresponding to the driving data (image data) is read out under the control of the memory control CPU 49. Various calculation methods are possible as the correction method. One preferred method is to multiply the image data with the correction value. The corrected image data is applied to the S/P converter 46. On the basis of the image data converted into parallel data by the S/P converter 46, the modulated signal generator 45 outputs modulated signals of one line simultaneously. In synchronism with this output, the scan signal generator 42 outputs a scan signal for selecting the line to be driven.

By a series of the above operations, the multiple electron beam source incorporated in the display panel 41 outputs electron beams in accordance with the image data. Since the driving signals applied to the surface conduction electron emitting devices are already corrected on the basis of the respective characteristics of the devices, electron beams can be output faithfully with respect to the image data supplied from the external signal source. That is, an image display-ban be performed with luminance faithful to the image signal.

The normal drive mode is executed following the procedure described above. Note that in this mode, none of the memory 51, the comparator 50, and the test pattern generator 53 need be operated.

Characteristic Change Check Mode

The characteristic change check mode will be described below. In this mode, a change with time in the electron emission characteristic of each surface conduction electron emitting device is checked, and the correction value for driving conditions stored in the memory 48 is adjusted on the basis of the check result where necessary. More specifically, whether a change with time occurs is checked for each device by comparing the latest result measured by the device current measurement circuit 43 with the device current (initial value) stored in the memory 51.

Figure 8:
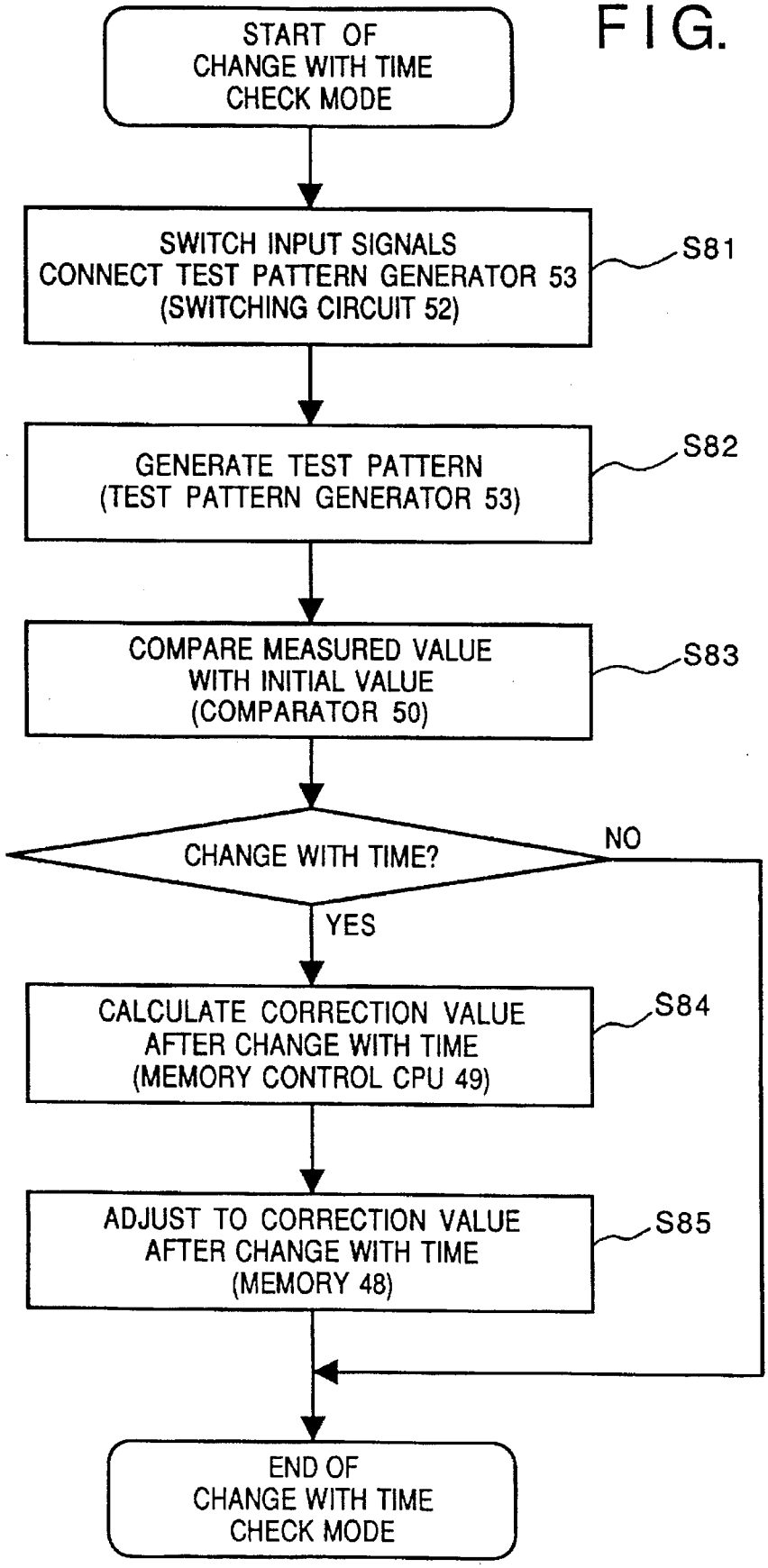
FIG. 8 is a flow chart showing the operation procedure in a characteristic change check mode in the second embodiment.

The operation procedure will be described below with reference to the flow chart in FIG. 8.

(S81): First, the internal switches of the switching circuit 52 are set to the positions on the test pattern generator 53 side. More specifically, the operation mode control CPU 54 performs this step by outputting the control signal Se1 to the switching circuit 52.

(S82): Subsequently, the test pattern generator 53 generates a driving signal for the check. This step is started when the operation mode control CPU 54 outputs the control signal Test to the test pattern generator 53.

(S83): The measured value and the initial value are compared.

To begin with, the device current is measured by the device current measurement circuit 43 and output to the comparator 50. More specifically, in this step, the timing controller 44 generates various timing control signals on the basis of the output sync signal from the test pattern generator 53, thereby adjusting the operation timings of the S/P converter 46, the modulated signal generator 45, the scan signal generator 42, and the memory control CPU 49. The output check driving data from the test pattern generator 53 is input to the arithmetic unit 47. Since in this stage the memory control CPU 49 performs control such that no correction value is read out from the memory 48, the driving data is directly input to the S/P converter 46. On the basis of the check driving data converted into parallel data by the S/P converter 46, the modulated signal generator 45 generates a modulated signal. Simultaneously, the device current measurement circuit 43 measures the device current flowing through each surface conduction electron emitting device.

At the same time, the device current (initial value) is read from the memory 51 and output to the comparator 50. In this stage, the operation mode control CPU 54 outputs to the memory control CPU 49 the instruction Mc indicating a read from the memory 51. Consequently, the read access to the memory 51 is done under the control of the memory control CPU 49.

The comparator 50 compares the measured value with the initial value. If it is determined that there is no change with time, the characteristic change check mode is ended. On the other hand, if it is determined that a change with time has taken place, the flow advances to (S84). Various methods can be used to determine the presence/absence of a change with time. Preferred examples are a method in which a change with time is detected if the difference between the measured value,and the initial value exceeds a predetermined range, and a method in which a change with time is detected if a ratio of the measured value to the initial value exceeds a certain range. In this embodiment, the former method is employed, and it is determined that a change with time has occurred if the difference between the measured value and the initial value exceeds 0.1 [mA].

(S84): For the surface conduction electron emitting device found to have a change with time, the memory control CPU 49 calculates the correction value for driving conditions after the change with time. Various calculation methods are usable in calculating the driving condition correction value. One preferred method is to divide a predetermined design value by the measured value after the change with time. That is, if the measured value after the change with time of a surface conduction electron emitting device whose design value of the device current is 3.3 [mA] is 2.7 [mA], the correction value calculated is approximately 1.2.

(S85): Subsequently, the driving condition correction value for the device having the change with time is adjusted. That is, the content of the memory 48 is rewritten by the driving condition correction value calculated in (S84) after the change with time has taken place.

The characteristic change check mode is executed following the above-mentioned procedure.

The contents of the three operation modes of the image display apparatus in FIG. 4 are explained above. The timings at which these operation modes are executed will be described below.

When the image display apparatus is manufactured, the initial characteristic check mode is first executed. Thereafter, the apparatus is operated in the normal drive mode, and the characteristic change check mode is executed at appropriate intervals by the instruction from the operation mode control CPU 54. One desirable method is the one in which the operation time in the normal drive mode is accumulated, and the characteristic change check mode is executed whenever a predetermined time (e.g., 100 hours) has elapsed. In some cases, it is also possible to execute the characteristic change check mode each time the power supply of the image display apparatus is turned on or off.

The image display apparatus as one embodiment of the present invention has been described above.

Note that a desirable check voltage used in measuring the device current in the initial characteristic check mode and in the characteristic change check mode will be explained later when the characteristics of the surface conduction electron emitting device are described.

In the above embodiment, the memory 51 is used as a read-only memory after the initial values of the device currents are written in the initial characteristic check mode. However, depending on the situation, the latest device current measured values can also be written in the memory 51 after the characteristic change check mode is executed. In these instances, it is possible to check whether another change with time has occurred after the characteristic change check mode is executed the last time and before it is executed this time. According to the idea of the present invention, the point is that it is only necessary to be able to detect a change in the electron emission characteristic of the surface conduction electron emitting device by detecting a change in the device current of the device, thereby properly correcting the driving conditions of the device.

(Multiple Electron Beam Source)

A method of manufacturing the multiple electron beam source used in the electron beam generating apparatus of the first embodiment and in the image display apparatus of the second embodiment will be described below. This multiple electron beam source for use in the image display apparatus of the present invention need only be an electron source in which surface conduction electron emitting devices are connected by simple matrix wiring. Therefore, the material, shape, and fabrication method of the surface conduction electron emitting devices are not particularly limited. The present inventors, however, have found that a surface conduction electron emitting device whose electron emission portion or its peripheral portion is formed of a fine-particle film is excellent in electron emission characteristics and easy to fabricate. Therefore, surface conduction electron emitting devices of this type can be said to be best suited to be used in the multiple electron beam source of a high-luminance, large-screen image display apparatus. For that reason, in the above embodiments, the surface conduction electron emitting devices whose electron emission portion or its peripheral portion is constructed of a fine-particle film are used. Therefore, the basic arrangement, fabrication method, and characteristics of a preferred surface conduction electron emitting device will be described first. The structure of the multiple electron beam source in which a large number of these devices are connected by simple matrix wiring will now be described.

Preferred Device construction and Fabrication Method of Surface Conduction Type Emission Device Planar and step type device constructions are representative constructions of a surface conduction electron emitting device whose electron emission portion or its peripheral portion is formed of a fine-particle film.

Planar Surface Conduction Type Emission Device

The device construction and fabrication method of a planar surface conduction electron emitting device will be described below.

Figure 12A:
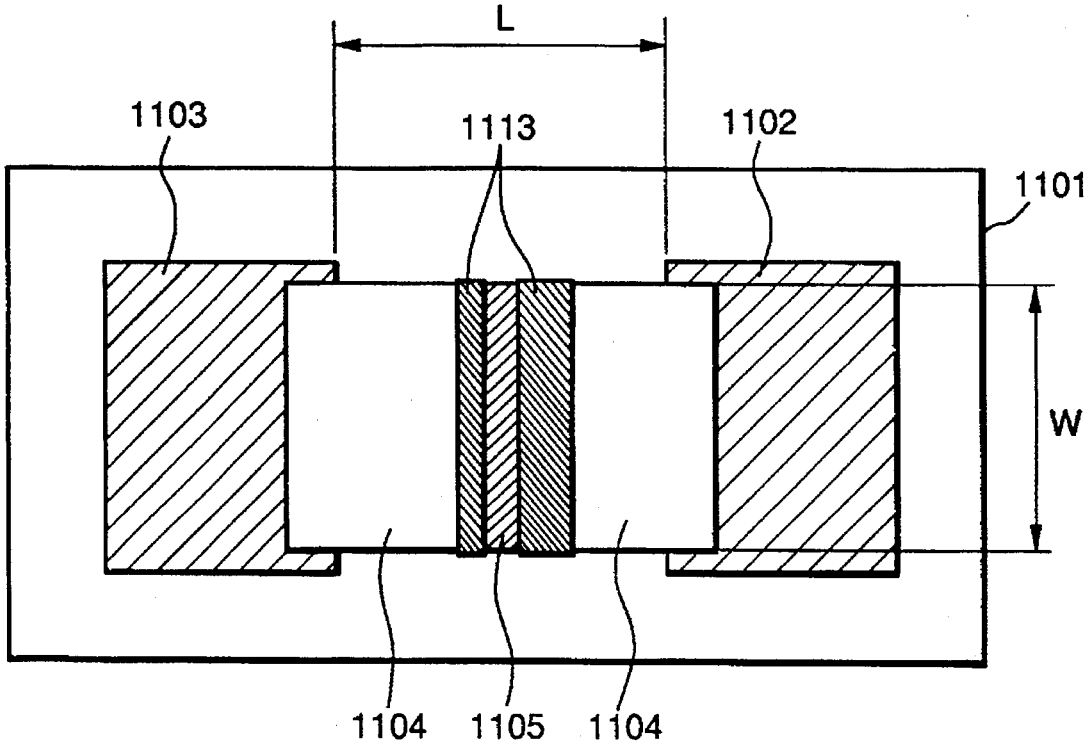
FIGS. 12A and 12B are plan and sectional views, respectively, of a planar surface conduction electron emitting device used in the embodiments.
Figure 12B:
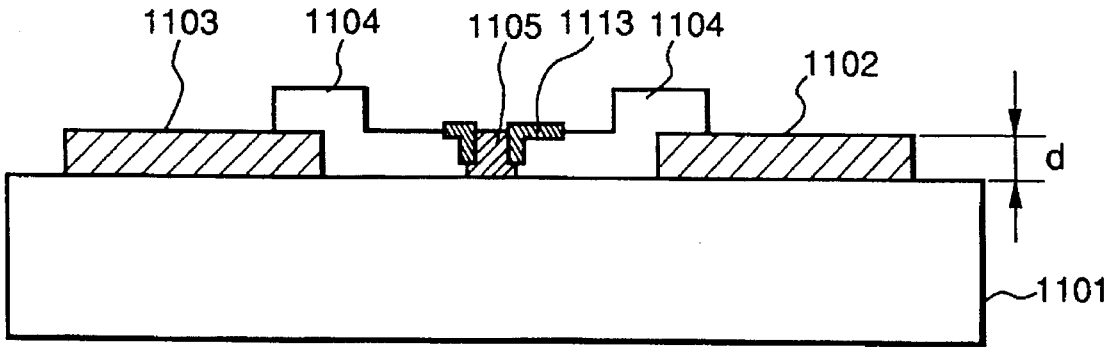

FIGS. 12A and 12B are plan and sectional views, respectively, for explaining the arrangement of a planar surface conduction electron emitting device. In FIGS. 12A and 12B, reference numeral 1101 denotes a substrate; 1102 and 1103, device electrodes; 1104, a thin conductive film; 1105, an electron emission portion formed by energization forming processing; and 1113, a thin film formed by energization activation processing.

As the substrate 1101, it is possible to use, e.g., various glass substrates such as quartz glass and soda lime glass substrates, various ceramic substrates such as an alumina substrate, and a substrate formed by stacking an insulating layer consisting of, e.g., $SiO_2$, on any of these substrates.

The device electrodes 1102 and 1103 formed on the substrate 1101 so as to be parallel to the substrate surface and oppose each other are made of a conductive material. For example, it is possible to properly choose to use metals such as Ni, Cr, Au, Mo, W, Pt, Ti, Cu, Pd, and Ag, alloys of these metals, metal oxides such as $In_2O_3$—$SnO_2$, and semiconductors such as polysilicon. The electrodes can be readily formed by using a combination of a film formation technique, such as vacuum vapor deposition, and a patterning technique, such as photolithography or etching. These electrodes can also be formed by using some other methods (e.g., a printing process).

The shape of the device electrodes 1102 and 1103 is appropriately designed to meet the application purpose of the electron emission device. Generally, an electrode distance L is designed by selecting an arbitrary value from the range from several hundred Å to several hundred μm. To apply the device to a display apparatus, the range from several μm to several ten μm is preferred. As a thickness d of the device electrodes, an appropriate value is usually chosen from the range from several hundred Å to several μm.

A fine-particle film is used as the thin conductive film 1104. A fine-particle film herein mentioned means a film (including an aggregate of islands) containing a large number of fine particles as the constituting elements. When the fine-particle film is inspected microscopically, a structure in which individual fine particles are spaced apart from each other, adjacent to each other. Or overlap each other is usually observed.

The particle size of the fine particles used in the fine-particle film ranges between several Å and several thousand Å. The particle size is most preferably 10 to 200 Å. The film thickness of the fine-particle film is properly set in consideration of various conditions; e.g., conditions required to electrically connect well the film to the device electrode 1102 or 1103., conditions required to successfully perform energization forming to be described later, and conditions required to set the electrical resistance of the fine-particle film itself to an appropriate value. More specifically, the film thickness is set between several Å and several thousand Å, most preferably between 10 Å and 500 Å.

Examples of materials usable in the formation of the fine-particle film are metals such as Pd, Pt, Ru, Ag, Au, Ti, In, Cu, Cr, Fe, Zn, Sn, Ta, W, and Pb; oxides such as PdO, $SnO_2$, $In_2O_3$, PbO, and $Sb_2O_3$; borides such as $HfB_2$, $ZrB_2$, $LaB_6$, $CeB_6$, $YB_4$, and $GdB_4$; carbides such as TiC, ZrC, HfC, TaC, SiC, and WC; nitrides such as TiN, ZrN, and HfN; semiconductors such as Si and Ge; and carbon. The material of the fine-particle film is properly selected from these materials.

The thin conductive film 1104 is formed of the fine-particle film as described above. The sheet resistance of the thin conductive film 1104 is set within the range from $10_3$ to $10_7$ (Ω/sq).

Note that the thin conductive film 1104 and the device electrodes 1102 and 1103 partially overlap each other, since it is desirable that these portions be electrically well connected. In the arrangement shown in FIGS. 12A and 12B, the substrate, the device electrodes, and the thin conductive film are stacked in this order from the bottom. In some instances, it is also possible to stack the substrate, the thin conductive film, and the device electrodes in the order named from the bottom.

The electron emission portion 1105 is a fissure-like portion formed in a portion of the thin conductive film 1104. The electron emission portion 1105 has a higher resistance than that of the thin conductive film surrounding this portion. The fissure is formed by performing energization forming processing (to be described later) for the thin conductive film 1104. In some cases, fine particles with a particle size from several Å to several hundred Å are arranged within the fissure. Note that since it is difficult to precisely and correctly depict the position and shape of an actual electron emission portion, the portion is schematically illustrated in FIGS. 12A and 12B.

The thin film 1113 consists of carbon or a carbon compound and covers the electron emission portion 1105 and its peripheral portion. The thin film 1113 is formed by performing energization activation processing after the energization forming processing.

The thin film 1113 consists of one of single-crystal graphite, polycrystalline graphite, and amorphous carbon, or a mixture thereof. The film thickness of the thin film 1113 is 500 [Å] or less, and more preferably 300 [Å] or less.

Note that the thin film 1113 is schematically illustrated in FIGS. 12A and 12B, since it is difficult to precisely depict the position and shape of an actual thin film. Note also that the plan view of FIG. 12A shows the device from which a portion of the thin film 1113 is removed.

The basic arrangement of the preferred device has been described above. The following device was used in the embodiments.

That is, soda lime glass was used as the substrate 1101, and a thin Ni film was used as the device electrodes 1102 and 1103. The thickness d of the device electrodes was set at 1,000 [Å], and the electrode distance L was set at 2 [μm].

Pd or PdO was used as the principal material of the fine-particle film. The thickness of the fine-particle film was set to about 100 [Å], and its width W was set to 100 [μm].

A method of fabricating the preferred planar surface conduction electron emitting device will be described below.

FIGS. 13A to 13E are sectional views for explaining the fabrication steps of the surface conduction electron emitting device. In FIGS. 13A to 13E, the same reference numerals as in FIGS. 12A and 12B denote the same parts.

Figure 13A:
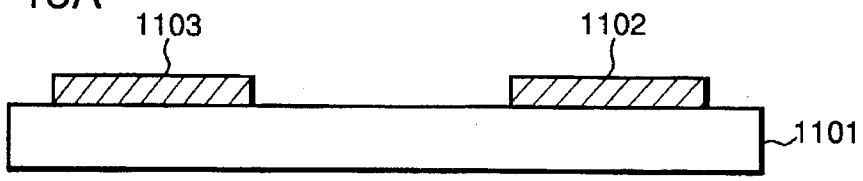
FIGS. 13A to 13E are sectional views showing the fabricating steps of the planar surface conduction electron emitting device.

1) First, as shown in FIG. 13A, device electrodes 1102 and 1103 are formed on a substrate 1101.

In this formation, the substrate 1101 is sufficiently cleaned with a detergent, distilled water, and an organic solvent, and then the material of the device electrodes is deposited. The method of deposition can be a vacuum film formation technique, e.g., vapor deposition or sputtering. Thereafter, the deposited electrode material is patterned by using photolithography and etching techniques to form a pair of the device electrodes (1102 and 1103) shown in FIG. 13A.

Figure 13B:
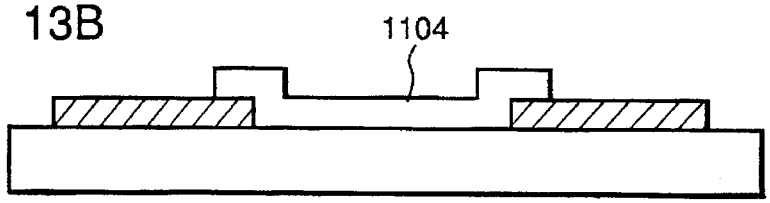

2) Subsequently, a thin conductive film 1104 is formed as in FIG. 13B.

That is, an organic metal solution is coated and dried on the substrate in FIG. 13A, and sintered with heat to form a fine-particle film, and the film is then etched into a predetermined shape by photolithography and etching. The organic metal solution is a solution of an organic metal compound containing as its main element the material of the fine particles used in the thin conductive film. More specifically, Pd was used as the major element in this embodiment. In addition, dipping was used as the coating method in this embodiment, but another method such as a spinner method or a spray method can also be used.

Figure 13C:
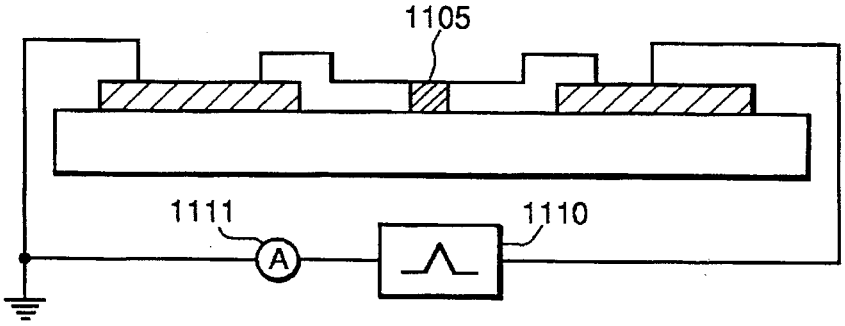

Also, as the method of forming the thin conductive film consisting of the fine-particle film, vacuum vapor deposition, sputtering, or chemical vapor phase deposition is sometimes used instead of coating of an organic metal solution used in this embodiment. 3) Subsequently, as in FIG. 13C, energization forming processing is performed by applying an appropriate voltage from a forming power supply 1110 to the device electrodes 1102 and 1103, forming an electron emission portion 1105.

The energization forming processing is to perform energization of the thin conductive film 1104 formed of the fine-particle film to destroy, deform, or modify a portion of the film to a proper extent, thereby changing the film into a structure suitable for electron emission. An appropriate fissure is formed in the portion (i.e., the electron emission portion 1105) of the thin conductive film consisting of the fine-particle film, which is changed to the structure suitable for electron emission. Note that the electrical resistance measured between the device electrodes 1102 and 1103 after the formation of the electron emission portion 1105 increased significantly compared to that before the formation.

Figure 14:
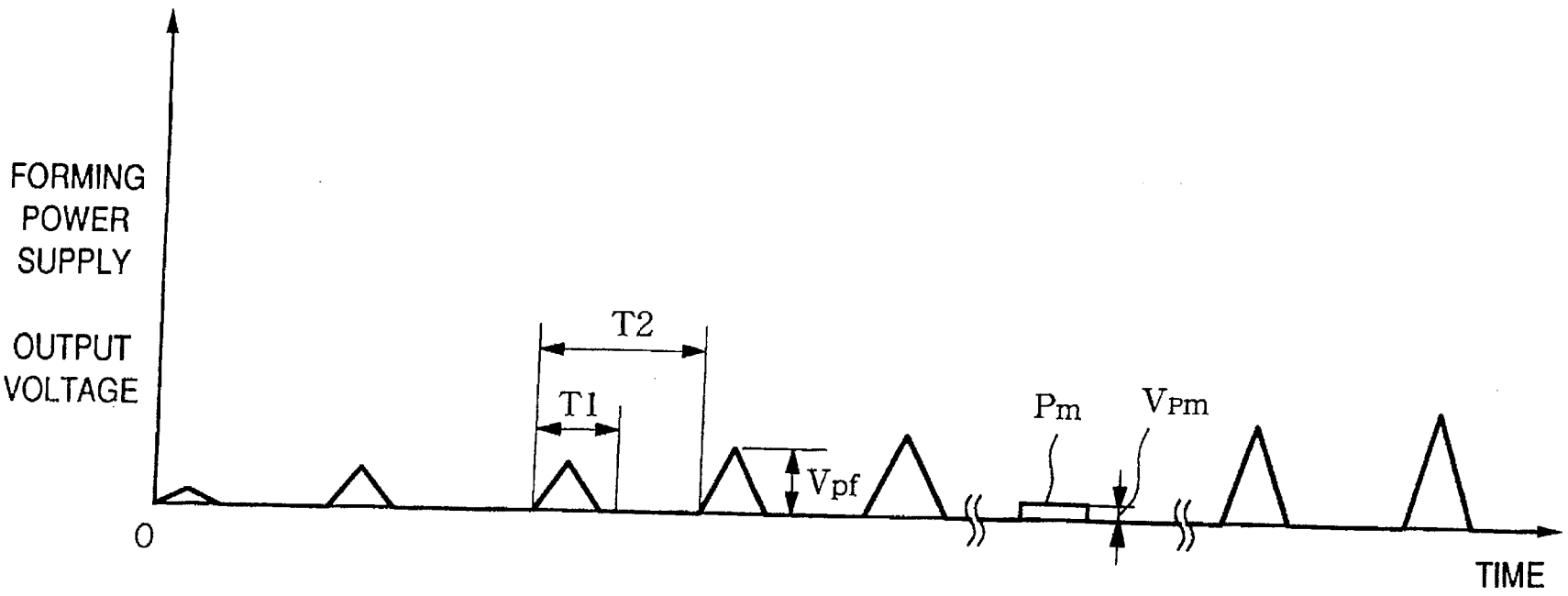
FIG. 14 is a waveform chart of an applied voltage in energization forming processing.

To explain details of the energization method, an example of the waveform of a voltage applied from the forming power supply 1110 is illustrated in FIG. 14. In energization forming a thin conductive film made of a fine-particle film, a pulse-like Voltage is preferred. In this embodiment, triangular pulses with a pulse width T1 were continuously applied at pulse intervals T2. During the application, a peak value Vpf of the triangular pulses was gradually increased. In addition, monitor pulses Pm for monitoring the formation state of the electron emission portion 1105 were inserted between the triangular pulses at appropriate intervals, and the current flowing upon the insertion was measured by an ammeter 1111.

In this embodiment, in a vacuum atmosphere of about $10^{-5}$ [torr], the pulse width T1 was set to 1 [ms], the pulse interval T2 was set to 10 [ms], and the peak value Vpf was increased by 0.1 [V] for each pulse. The monitor pulse Pm was inserted each time five triangular pulses were applied. To avoid an adverse effect on the energization forming processing, a voltage Vpm of the monitor pulse was set at 0.1 [V]. The energization for the energization forming processing was ended when the electrical resistance between the device electrodes 1102 and 1103 became $1\times10^{6}$ [Ω], i.e., when the current measured by the ammeter 1111 upon application of the monitor pulse became $1\times10^{-7}$ [A] or less. Note that the above method is a preferred method for the surface conduction electron emitting device of this embodiment. Therefore, if the design of the surface conduction electron emitting device is altered, e.g., if the material or film thickness of the fine-particle film or the device electrode distance L is changed, it is desirable to properly change the energization conditions in accordance with the change.

Figure 13D:
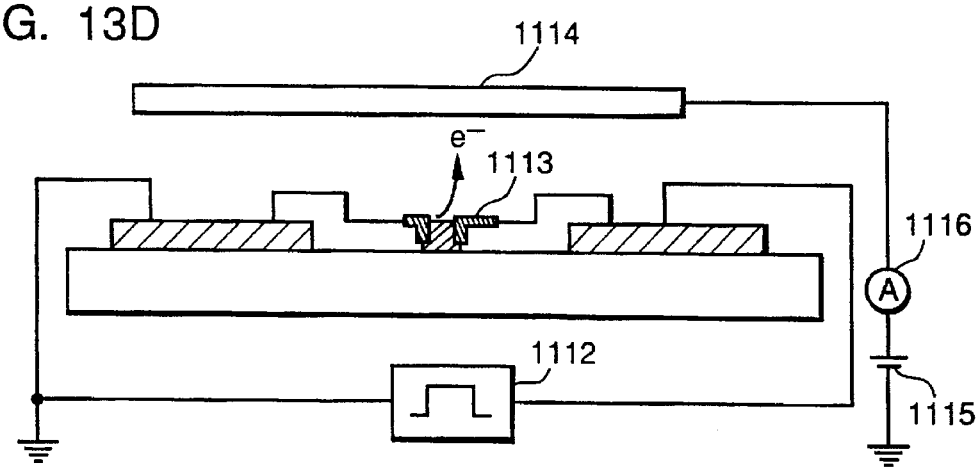

4) Subsequently, as illustrated in FIG. 13D, energization activation processing is performed by applying an appropriate voltage from an activation power-supply 1112 to the device electrodes 1102 and 1103, thereby improving the electron emission characteristics.

The energization activation processing is to apply a voltage under given conditions across the electron emission portion 1105 formed by the energization forming processing, thereby depositing carbon or a carbon compound near the electron emission portion 1105. In FIG. 13D, a deposit of carbon or of a carbon compound is schematically illustrated as a member 1113. Note that the energization activation processing can increase the emission current to be, typically, 100 times that before the processing at the same applied voltage.

More specifically, by periodically applying voltage pulses in a vacuum atmosphere within the range from $10^{-4}$ to $10^{-5}$ [torr], carbon or a carbon compound originating from an organic compound present in the vacuum atmosphere is deposited. The deposit 1113 is one of single-crystal graphite, polycrystalline graphite, and amorphous carbon, or a mixture thereof. The film thickness of the deposit 1113 is 500 [Å] or less, more preferably 300 [Å] or less.

Figure 15A:
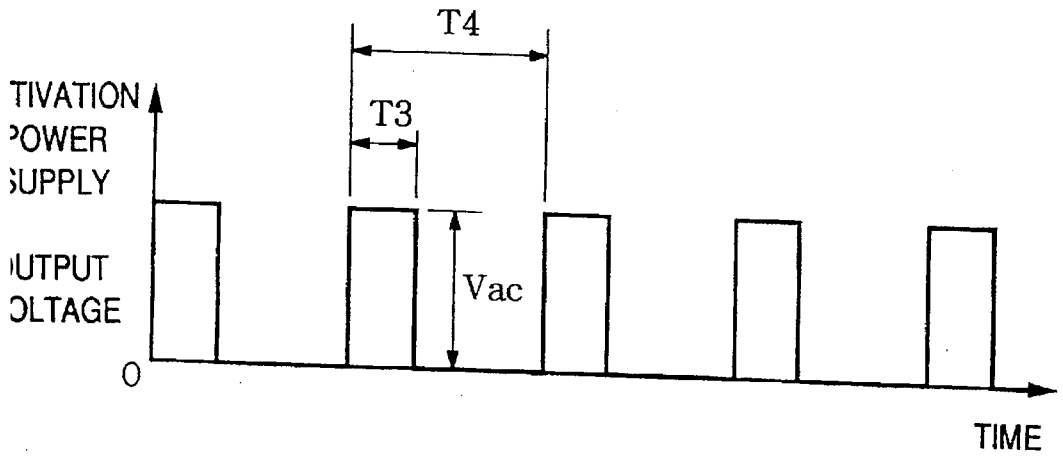
FIGS. 15A and 15B are waveform charts of an applied voltage and the change in an emission current Ie, respectively, in energization activation processing.

To explain the details of the energization method, an example of the waveform of a voltage applied from the activation power supply 1112 is shown in FIG. 15A. In this embodiment, the energization activation processing was done by periodically applying a rectangular wave at a fixed voltage. More specifically, a voltage Vac, a pulse width T3, and a pulse interval T4 of the rectangular wave were 14 [V], 1 [ms], and 10 [ms], respectively. Note that the above energization conditions were preferred conditions for the surface conduction electron emitting device of this embodiment. If, therefore, the design of the surface conduction electron emitting device is changed, it is desirable that the conditions be properly altered in accordance with the change.

In FIG. 13D, reference numeral 1114 denotes an anode electrode for capturing an emission current Ie from the surface conduction electron emitting device. The anode electrode 1114 is connected to a DC high-voltage power supply 1115 and an ammeter 1116. Note that the phosphor screen of the display panel is used as the anode electrode 1114 in performing the activation processing after the substrate 1101 is incorporated into the display panel.

Figure 15B:
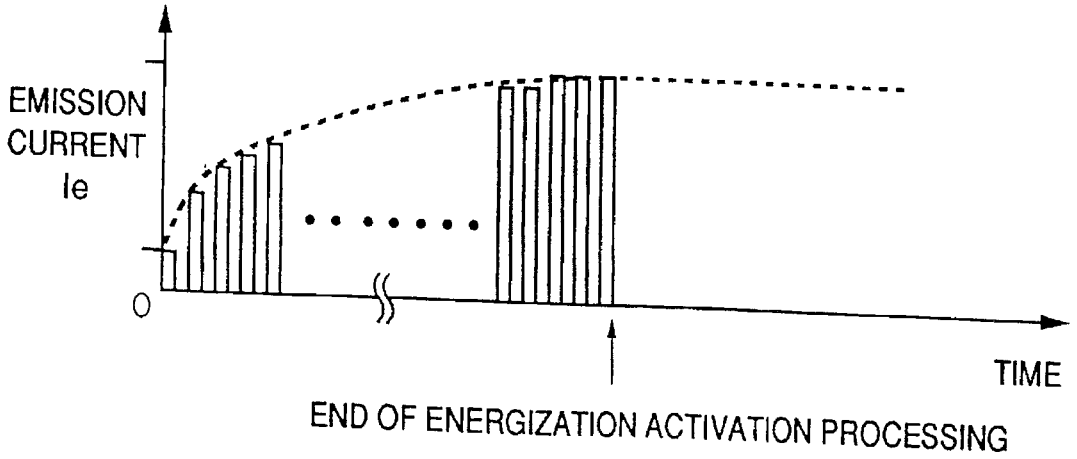

While the activation power supply 1112 is applying the voltage, the progress of the energization activation processing is monitored by measuring the emission current Ie with the ammeter 1116, thereby controlling the operation of the activation power supply 1112. FIG. 15B shows an example of the emission current Ie measured by the ammeter 1116. When the activation power supply 1112 starts applying the pulse voltage, the emission current Ie increases with time for some time and eventually saturates, i.e., becomes almost unable to increase. When the emission current Ie is almost saturated, the voltage application from the activation power supply 1112 is stopped to end the energization activation processing.

Note that the above voltage application conditions are preferred conditions for the surface conduction electron emitting device of this embodiment. Therefore, if the design of the surface conduction electron emitting device is altered, the conditions also are desirably, appropriately altered in accordance with the change.

Figure 13E:
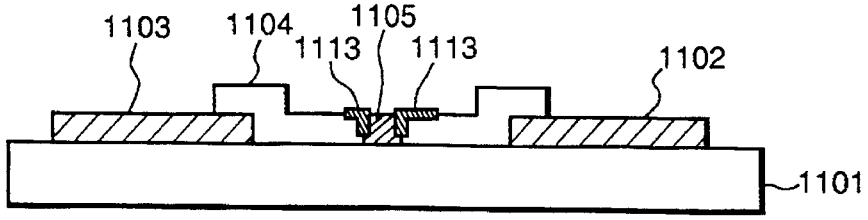

In this manner, the planar surface conduction electron emitting device illustrated in FIG. 13E was fabricated.

Step Type Surface Conduction Type Emission Device

Another representative construction of the surface conduction electron emitting device in which an electron emission portion or its peripheral portion is formed of a fine-particle film, i.e., the construction of a step type surface conduction electron emitting device will be described below.

Figure 16:
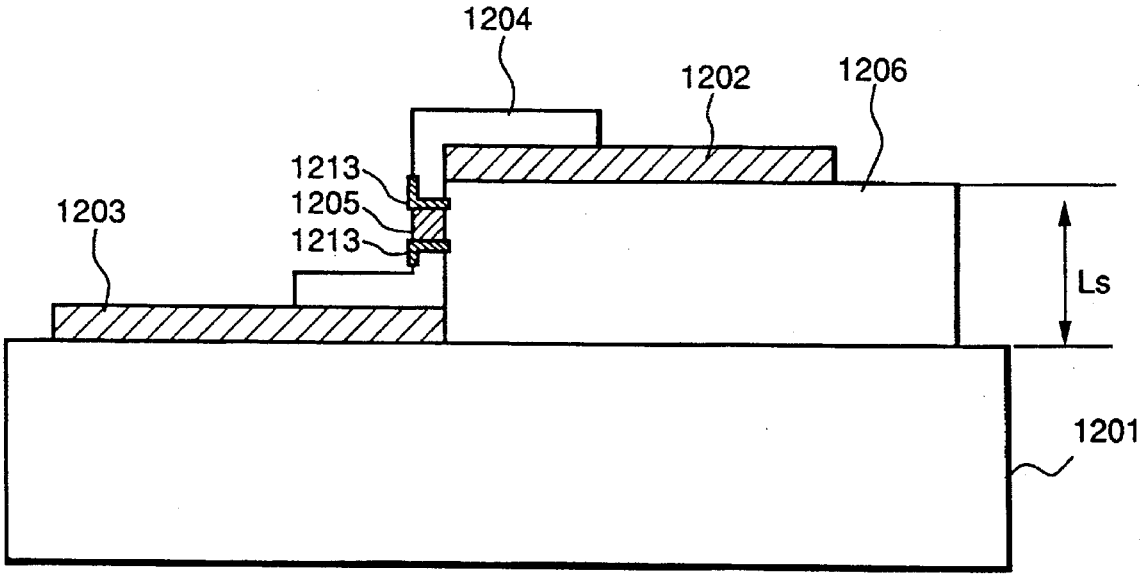
FIG. 16 is a sectional view of a step type surface conduction electron emitting device used in the embodiments.

FIG. 16 is a schematic sectional view for explaining the basic arrangement of the step type device. In FIG. 16, reference numeral 1201 denotes a substrate; 1202 and 1203, device electrodes; 1206, a step forming member; 1204, a thin conductive film using a fine-particle film; 1205, an electron emission portion formed by energization forming processing; and 1213, a thin film formed by energization activation processing.

The difference between the step type device from the planar type device described above is that one (1202) of the device electrodes is formed on the step forming member 1206 and the thin conductive film 1204 covers the side surface of the step forming member 1206. Therefore, the device electrode distance L in the planar type device shown in FIGS. 12A and 12B is set as a step height Ls of the step forming member 1206 in the step type device. Note that the substrate 1201, the device electrodes 1202 and 1203, and the thin conductive film 1204 using a fine-particle film can be made from the same materials as enumerated above in the description of the planar type device. Note also that an electrically insulating material, e.g., $SiO_2$, is used as the step forming member 1206.

A fabrication method of the dyrp type surface conduction electron emitting device will be described below. FIGS. 17A to 17F are sectional views for explaining the fabrication steps, in which the same reference numerals as in FIG. 16 denote the same parts.

Figure 17A:
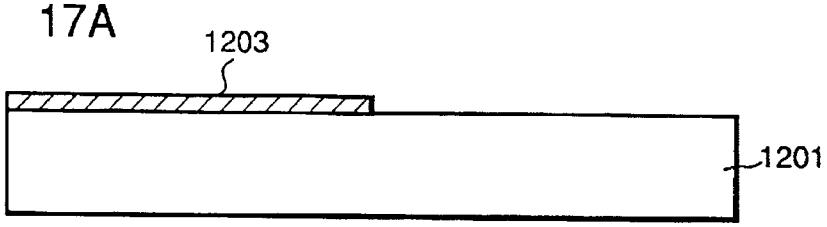
FIGS. 17A to 17F are sectional views showing the fabrication steps of the step type surface conduction electron emitting device.
Figure 17B:
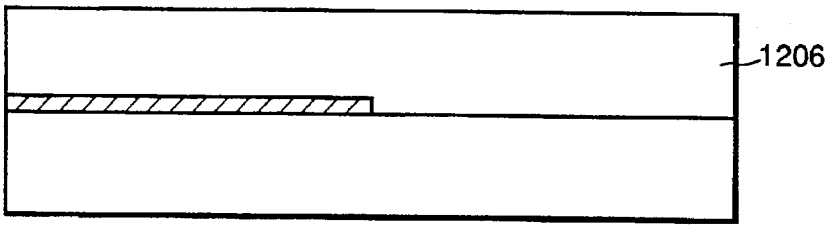
Figure 17C:
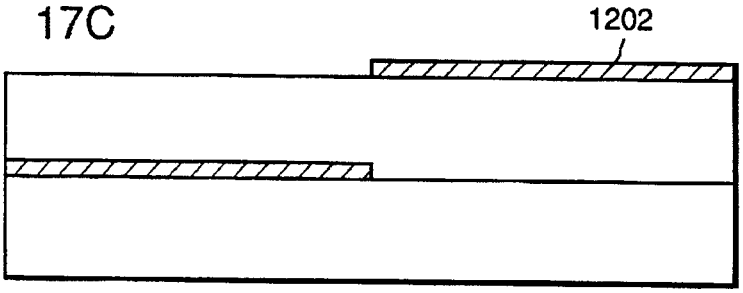
Figure 17D:
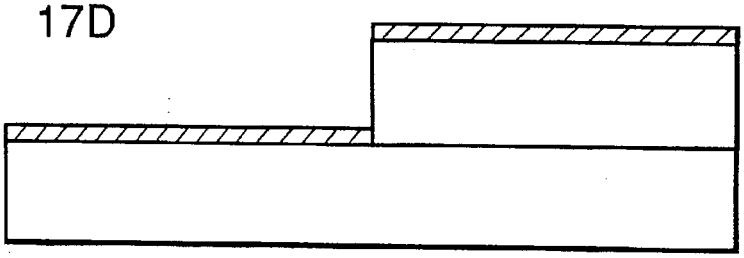
Figure 17E:
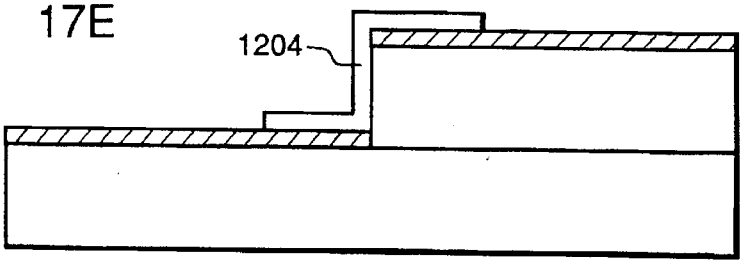

1) First, as illustrated in FIG. 17A, a device electrode 1203 is formed on a substrate 1201.
2) Subsequently, as shown in FIG. 17B, an insulating layer for forming a step-forming member 1206 is stacked. This insulating layer can be formed by stacking, e.g., $SiO_2$ by sputtering. Another film formation method such as vacuum vapor deposition or printing also may be used. 3) A device electrode 1202 is then formed on the insulating layer as in FIG. 17C. 4) Subsequently, as in FIG. 17D, a portion of the insulating layer is removed by using, e.g., etching, to expose the device electrode 1203.
5) Thereafter, a thin conductive film 1204 using a fine-particle film is formed as shown in FIG. 17E. The formation can be done by use of a film formation technique such as a coating method, as in the formation of the planar type device.
6) Subsequently, as in the case of the planar type device, energization forming processing is performed to form an electron emission portion. This energization forming processing can be identical to that for the planar type device described above with reference to FIG. 13C.
7) Lastly, energization activation processing is performed in the same fashion as in the planar type device, depositing carbon or a carbon compound near the electron emission portion. This energization activation processing can also be the same as in the planar type device described above with reference to FIG. 13D.

Figure 17F:
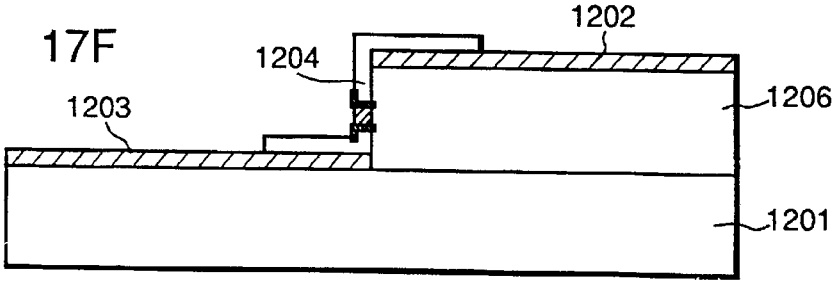

As described above., the step type surface conduction electron emitting device illustrated in FIG. 17F was fabricated.

Characteristics of Surface Conduction Type Emission Device Used in Embodiments The device constructions and fabrication methods of the planar and step type surface conduction electron emitting devices have been described above. The characteristics of the devices used in the embodiments will be described next.

Figure 18:
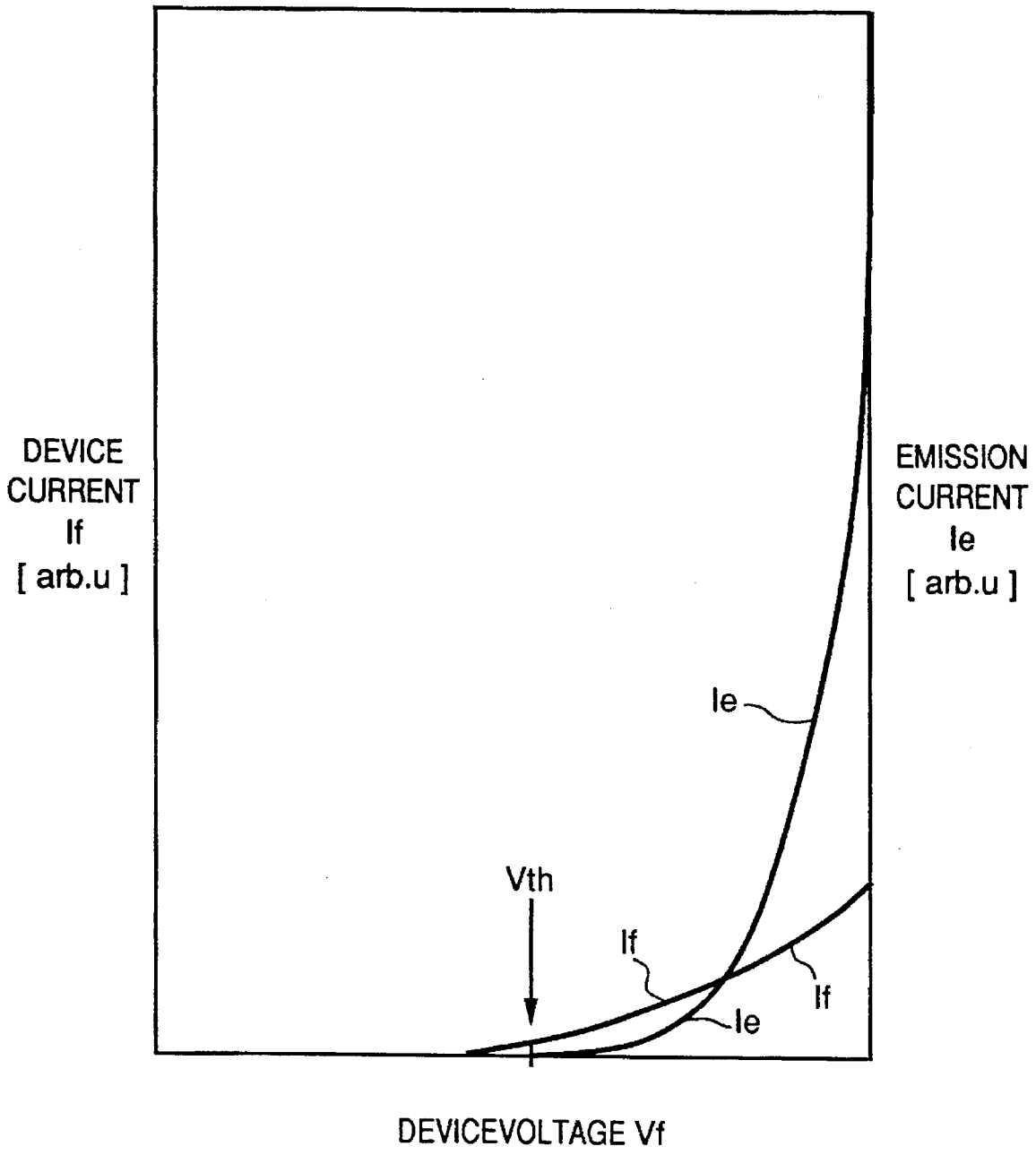
FIG. 18 is a graph showing typical characteristics of the surface conduction electron emitting device used in the embodiments.

FIG. 18 shows typical examples of the (emission current Ie) vs. (device applied voltage Vf) characteristic and the (device current If) vs. (device applied voltage Vf) characteristic of the devices used in the embodiments. Note that since the emission current Ie is significantly small compared to the device-current If and consequently these currents are difficult to depict in the same scale, and since these characteristics change with changes in the design parameters, e.g., the size or shape of the devices, the two curves in FIG. 18 are plotted in their respective arbitrary units.

The devices used in the display apparatus have the following three characteristics in relation to the emission current Ie.

First, the emission current Ie abruptly increases upon application of a voltage equal to or higher than a certain voltage (called a threshold voltage Vth). On the other hand, at voltages lower than this threshold voltage Vth, almost no emission current Ie is detected.

That is, the device of the present invention is a nonlinear device having a distinct threshold voltage Vth with respect to the emission voltage Ie.

Second, since the emission current Ie changes in accordance with the voltage Vf applied to the device, the magnitude of the emission current Ie can be controlled by the voltage Vf.

Third, the response speed of the current Ie emitted from the device is high with respect to the voltage Vf applied to the device. Therefore, the charge amount of electrons emitted from the device can be controlled by the length of the application time of the voltage Vf.

The above characteristics of the surface conduction electron emitting devices made it possible to suitably use the devices in display apparatuses. As an example, in a display apparatus in which a large number of these devices are provided in a one-to-one correspondence with the picture elements of the display screen, images can be displayed by sequentially scanning the display screen. That is, a given voltage equal to or higher than the threshold voltage Vth is applied to devices being driven in accordance with a desired luminance, while a voltage lower than the threshold voltage Vth is applied to devices in a non-selected state. By sequentially switching devices to be driven, images can be displayed by sequentially scanning the display screen.

Also, a multi-gradation display can be performed because the luminance can be controlled by using the second or third characteristic.

Variations found in the characteristics of a plurality of surface conduction electron emitting devices will be described below with reference to FIG. 9.

Figure 9:
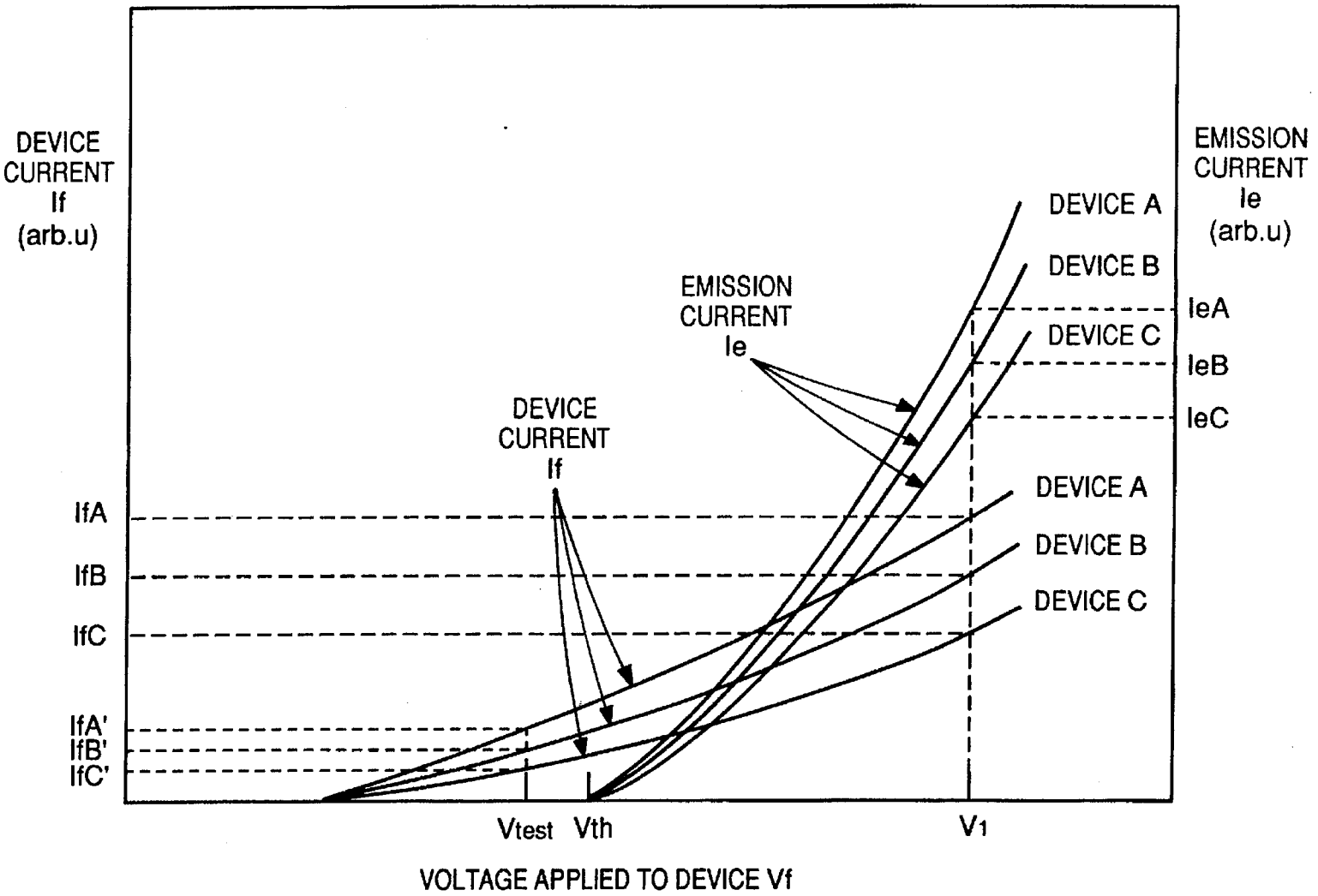
FIG. 9 is a graph showing variations in the characteristics of surface conduction electron emitting devices.

The plots in FIG. 9 indicate typical examples of variations in the characteristics of a plurality of surface conduction electron emitting devices. That is, FIG. 9 illustrates initial variations which have already occurred immediately after the fabrication, or variations caused by changes with time after the devices are driven for an arbitrary period of time.

The curves plotted in FIG. 9 represent the (applied voltage Vf vs. device current Ie) characteristic and the (applied voltage Vf vs. emission current Ie) characteristic of each of three devices A, B, and C. It is evident from FIG. 9 that a close correlation exists between the device current If and the emission current Ie; generally, a device with a large device current If has a large emission current Ie. Assuming the ratio of the emission currents Ie of these devices at a given voltage V1 equal to or higher than the electron emission threshold voltage Vth is IeA:IeB:IeC, this ratio nearly equals the ratio Ifa:IfB:IfC of the device currents If at that voltage. This ratio is also almost equal to the ratio IfA':IfB':IfC' of the device currents at a voltage lower than the electron emission threshold voltage Vth.

This property can be said to be inherent in the surface conduction electron emitting device; i.e., the property cannot be found in other cold and thermionic cathode devices such as FE devices and MIM devices. The present invention positively takes advantage of this property of the surface conduction electron emitting device. That is, as described earlier, initial variations or changes with time are detected by measuring the device current If in the electron beam generating apparatus of the first embodiment or in the image display apparatus of the second embodiment.

Note that as described above, even at voltages lower than the electron emission threshold voltage Vth, it is possible to detect initial variations or changes with time in the device characteristics by measuring the device currents. By measuring the device current at such a low voltage, it is possible to prevent generation of unnecessary electron beams in an electron beam generating apparatus, and to prevent emission of unnecessary light in an image display apparatus. The power consumed in the check can also be low. In the first and second embodiments described above, therefore, the device current If was measured by applying a voltage Vtest lower than the electron emission threshold voltage Vth. Note that if the measurement voltage Vtest is too low, in some cases, the absolute value of the device current If becomes small resulting in degradation of measurement accuracy. Therefore, Vtest is preferably set within the range of, e.g., Vth/2<Vtest<Vth.

Structure of Multiple Electron Beam Source in Which a Plurality of Devices Are Connected by Simple Matrix Wiring The structure of a multiple electron beam source in which the surface conduction electron emitting devices described above are arranged on a substrate and connected by simple matrix wiring will be described below.

Figure 10:
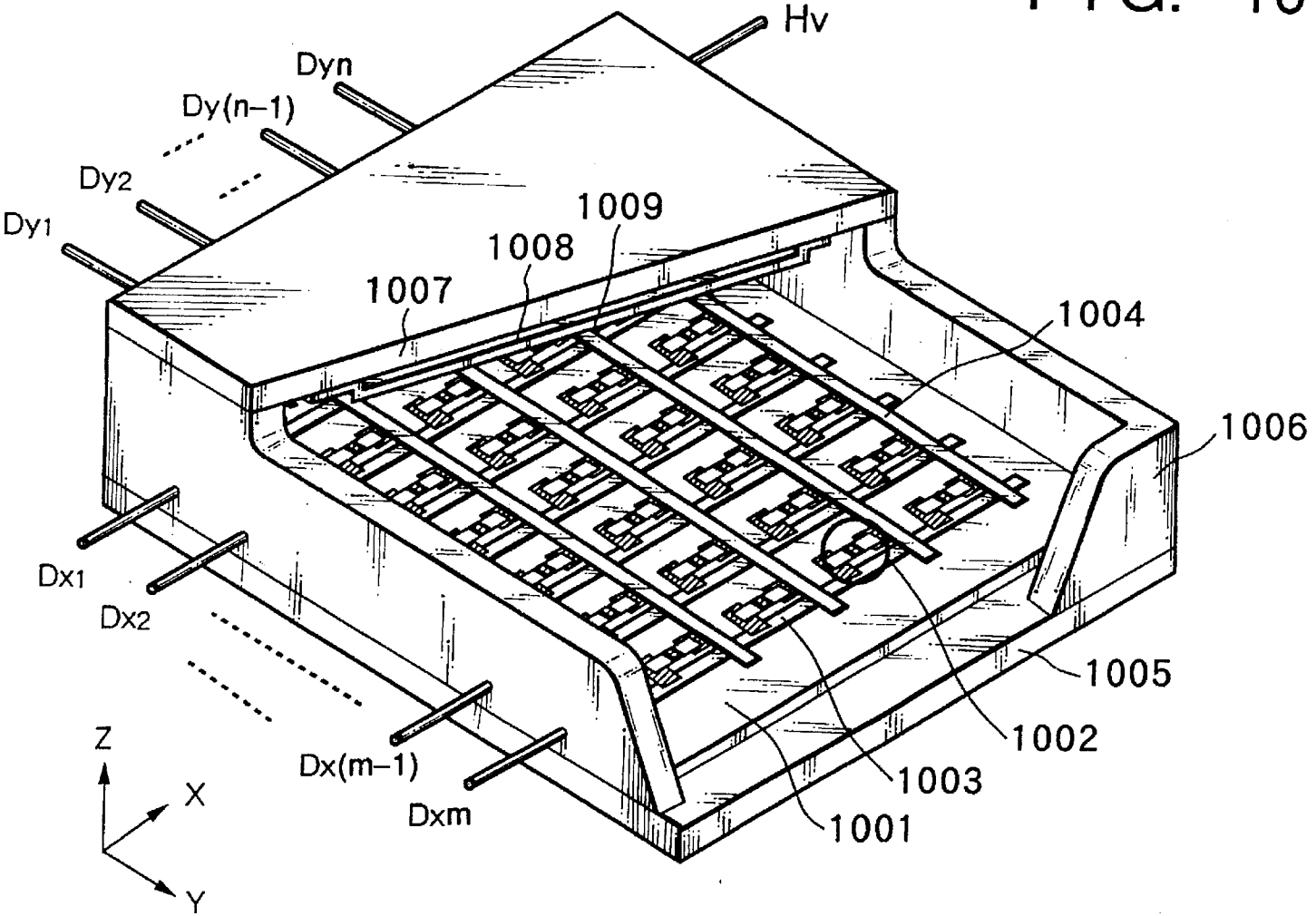
FIG. 10 is a perspective view of the image display apparatus according to the second embodiment of the present invention, in which a display panel is partially cut away.
Figure 19:
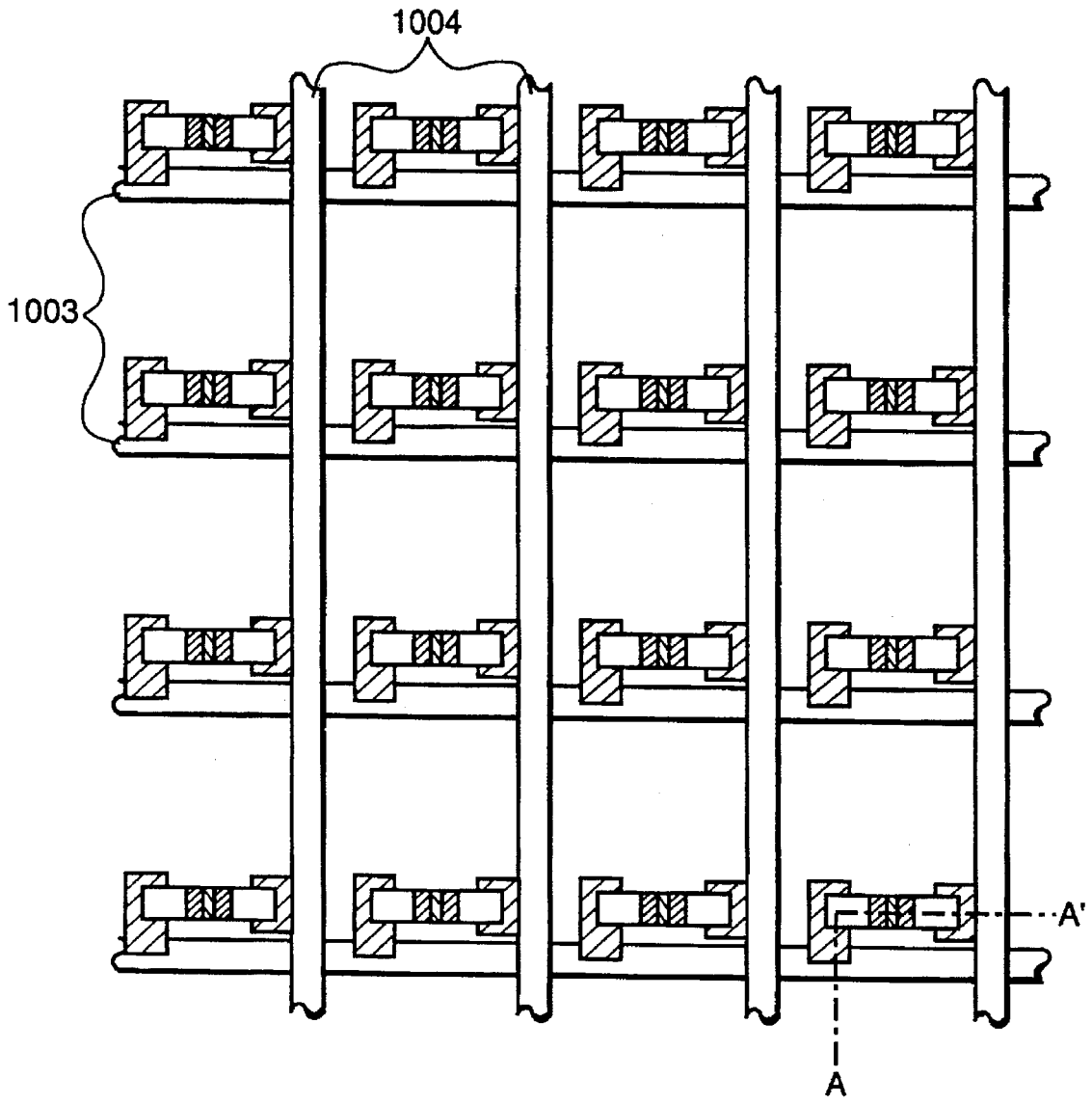
FIG. 19 is a plan view of the substrate of a multiple electron beam source used in the embodiments.

FIG. 19 shows a plan view of the multiple electron beam source used in the display panel illustrated in FIG. 10. On the substrate, surface conduction election emitting devices identical to the one illustrated in FIGS. 12A and 12B are arranged. These surface : conduction electron emitting devices are connected in a simple matrix manner by row-direction wiring electrodes 1003 and column-direction wiring electrodes 1004. An interelectrode insulating layer (not shown) is formed at each intersection of the row- and column-direction wiring electrodes 1003 and 1004 to keep an electrical insulation.

Figure 20:
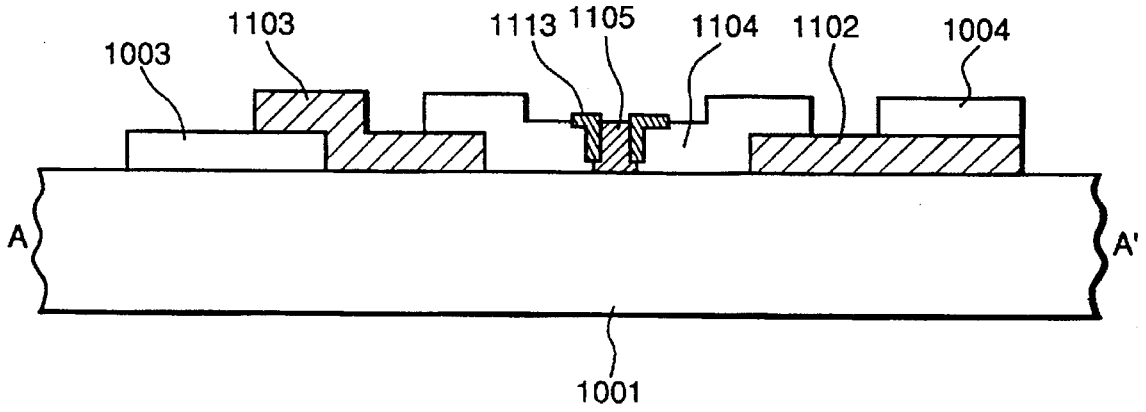
FIG. 20 is a sectional view of a portion of the substrate of the multi-beam electron source used in the embodiments.

FIG. 20 shows the section taken along the line A -A' in FIG. 19.

The multiple electron beam source with this structure was manufactured by forming the row-direction wiring electrodes 1003, the column-direction wiring electrodes 1004, the interelectrode insulating layer (not shown), and the device electrodes and the thin conductive film of each surface conduction electron emitting device on the substrate, and performing energization forming processing and energization activation processing by supplying power to the individual devices through the row- and column-direction wiring electrodes 1003 and 1004.

(Arrangement and Manufacturing Method of Display Panel)

The arrangement and the manufacturing method of the display panel 41 used in the second embodiment will be described below by using a practical example.

FIG. 10 is a perspective view of the display panel 41 used in the second embodiment, in which a portion of the panel is cut away to show the internal structure.

In FIG. 10, reference numeral 1005 denotes a rear plate; 1006, a side wall; and 1007, a faceplate. These members 1005 to 1007 form an airtight vessel for maintaining the interior of the display panel in a vacuum. In assembling the airtight vessel, sealing must be performed to allow the connected portion of each member to keep a sufficient strength and airtightness. This sealing was achieved by coating, e.g., frit glass on each connected portion and sintering the resultant structure in an outer atmosphere or in a nitrogen atmosphere at 400° to 500° C. for 10 minutes or more. A method Of evacuating the airtight vessel will be described later.

A substrate 1001 is fixed to the rear plate 1005, and N×M surface conduction electron emitting devices 1002 are formed on the substrate 1001. (N and M are positive integers of 2 or more and are properly set in accordance with the intended number of display pixels. In a display apparatus for a high-definition television purpose, for example, it is desirable that N=3000 or more and M=1000 or more. In this embodiment, N=3072 and M=1024.) The N×M surface conduction electron emitting devices are connected by simple matrix wiring by the M row-direction lines 1003 and the N column-direction lines 1004. A portion constituted by the members 1001 to 1004 is called a multiple electron beam source. Note that the manufacturing method and the structure of the multiple electron beam source are already described in detail in the preceding section and therefore will be omitted.

In the display panel, the substrate 1001 of the multiple electron beam source is fixed to the rear plate 1005 of the airtight vessel. However, if the substrate 1001 of the multiple electron beam source has a sufficient strength, the substrate 1001 itself of the multiple electron beam source can be used as the rear plate of the airtight vessel.

Figure 11A:
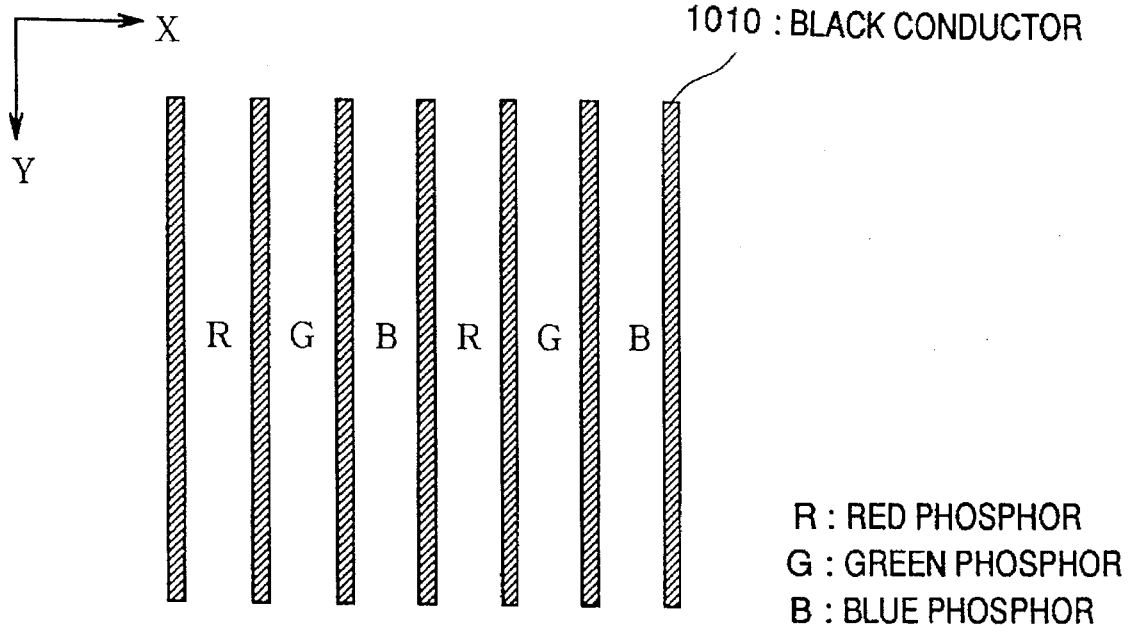
FIGS. 11A and 11B are views showing examples of a phosphor array on the faceplate of the display panel.

A phosphor film 1008 is formed on the lower surface of the faceplate 1007. Since this embodiment is a color display apparatus, phosphors of three primary colors, i.e., red, green, and blue, used in the field of CRTs, are separately coated as the phosphor film 1008. As illustrated in FIG. 11A, these phosphors of three colors are separately coated into stripes, and a black conductors 1010 are provided between the phosphor stripes. This black conductor 1010 is provided for the purposes of preventing color misregistration even if the irradiation position of an electron beam slightly shifts, preventing a decrease in the display contrast by preventing deflection of external light, and preventing charge-up of the phosphor film caused by an electron beam. Although graphite was used as the major component of the black conductor 1010, some other material can also be used as long as the material meets the above purposes.

Figure 11B:
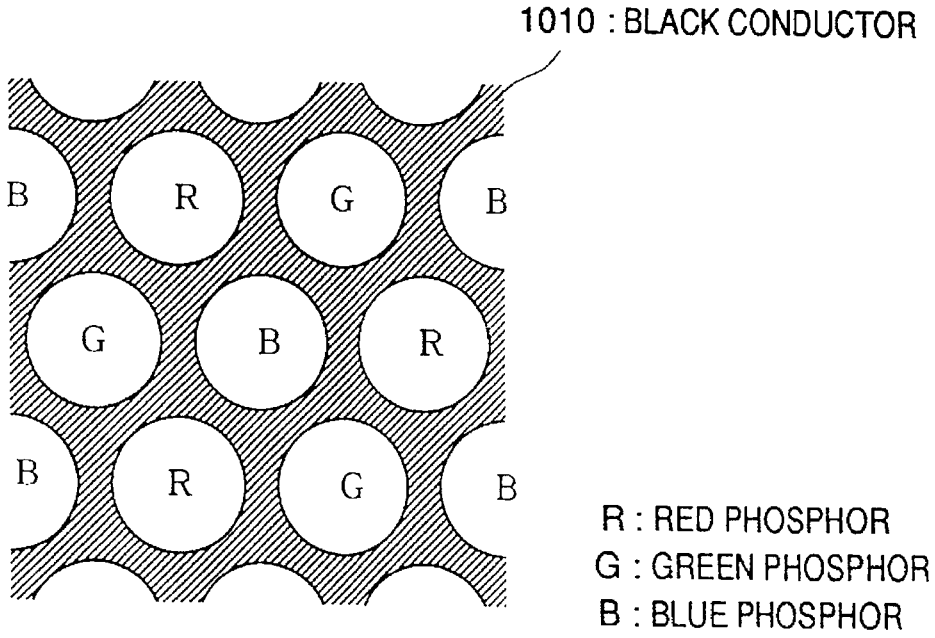

The coating form of the phosphors of three primary colors is not limited to the stripe-like arrangement illustrated in FIG. 11A. For example, the coating form can be a delta-like arrangement as shown in FIG. 11B or some other arrangement.

Note that in the formation of a monochromatic display panel, any black conductor material need not be used since it is only necessary to use a monochromatic phosphor material as the phosphor film 1068.

On the surface of the phosphor film 1008 on the rear plate side, a metallized screen 1009 well-known in the field of CRTs is formed. The metallized screen 1009 is formed for the purposes of improving the light use efficiency by mirror-surface-reflecting a portion of the light emitted by the phosphor film 1008, and protecting the phosphor film 1008 from collisions of negative ions. Also, the metallized screen 1009 is made to operate as an electrode for applying an electron beam acceleration voltage and as a conductive path for electrons that have excited the phosphor film 1008. After the phosphor film 1008 is formed on the faceplate substrate 1001, the metallized screen 1009 is formed by smoothening the surface of the phosphor film and vapor-depositing Al on the surface in a vacuum. Note that the metallized screen 1009 is unnecessary when a low-voltage phosphor material is used as the phosphor film 1008.

Although not used in this embodiment, a transparent electrode constructed of, e.g., ITO can also be formed between the faceplate substrate 1007 and the phosphor film 1008 to apply the acceleration voltage or to improve the conductivity of the phosphor film.

Reference symbols $D_{x1}$ to $D_{xm}$, $D_{y1}$ to $D_{yn}$ and Hv denote electrical connection terminals with the airtight structure, which are provided to electrically connect this display panel to an electric circuit (not shown). The terminals $D_{x1}$ to $D_{xm}$ are electrically connected to the row-direction lines 1003 of the multiple electron beam source, the terminals $D_{y1}$ to $D_{yn}$ are electrically connected to the column-direction lines 1004 of the multiple electron beam source, and the terminal Hv is electrically connected to the metallized screen 1009 Of the faceplate.

To evacuate the airtight vessel, an exhaust pipe and a vacuum pump (neither are shown) are connected to the airtight vessel after the vessel is assembled, and the vessel is evacuated to a vacuum degree of about $10^{-7}$ [torr]. Thereafter, the exhaust pipe is sealed. To maintain the vacuum degree in the airtight vessel, a getter film (not shown) is formed immediately before or after the sealing. The getter film is formed by vapor-depositing a getter material containing Ba as its main constituent with heat by using a heater or RF heating. By the adsorbing action of this getter film, the interior of the airtight vessel is held at a vacuum degree of $1\times10^{-5}$ to $1\times10^{-7}$ [torr].

The basic arrangement and the manufacturing method of the display panel 41 of the second embodiment are described above.

(3rd Embodiment)

Figure 21:
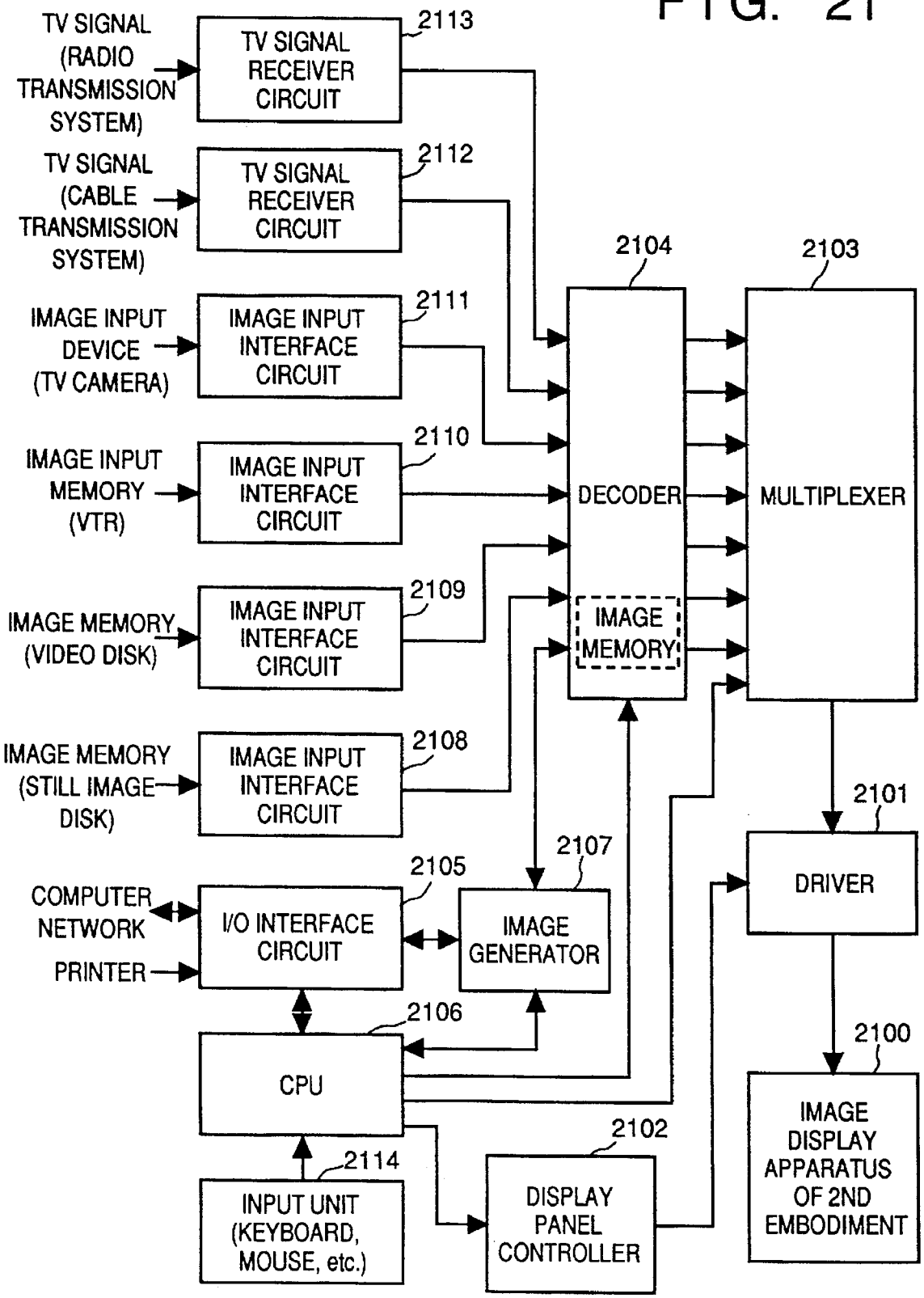
FIG. 21 is a block diagram of a multifunction image display apparatus according to the third embodiment of the present invention.
Figure 22:
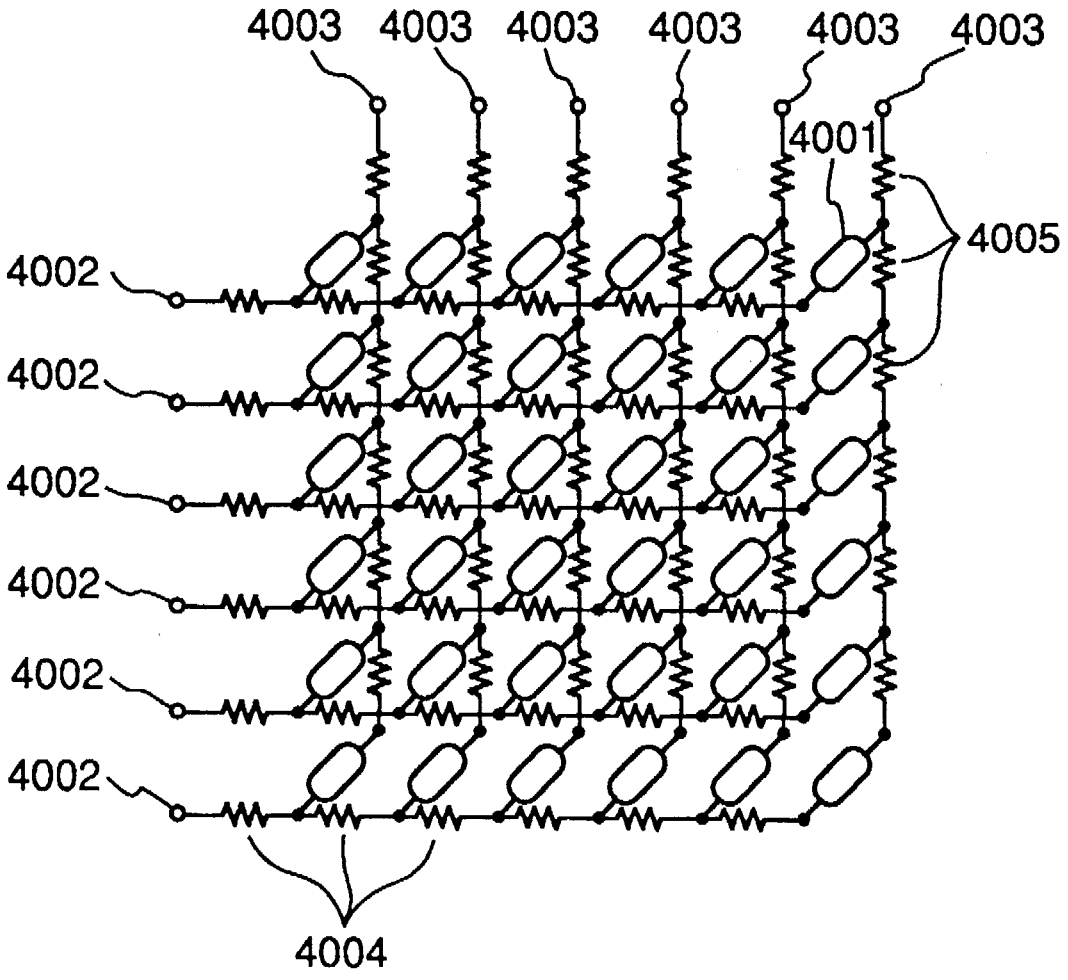
FIG. 22 is a view for explaining the electron emission device wiring method attempted by the present inventors.
Figure 23:
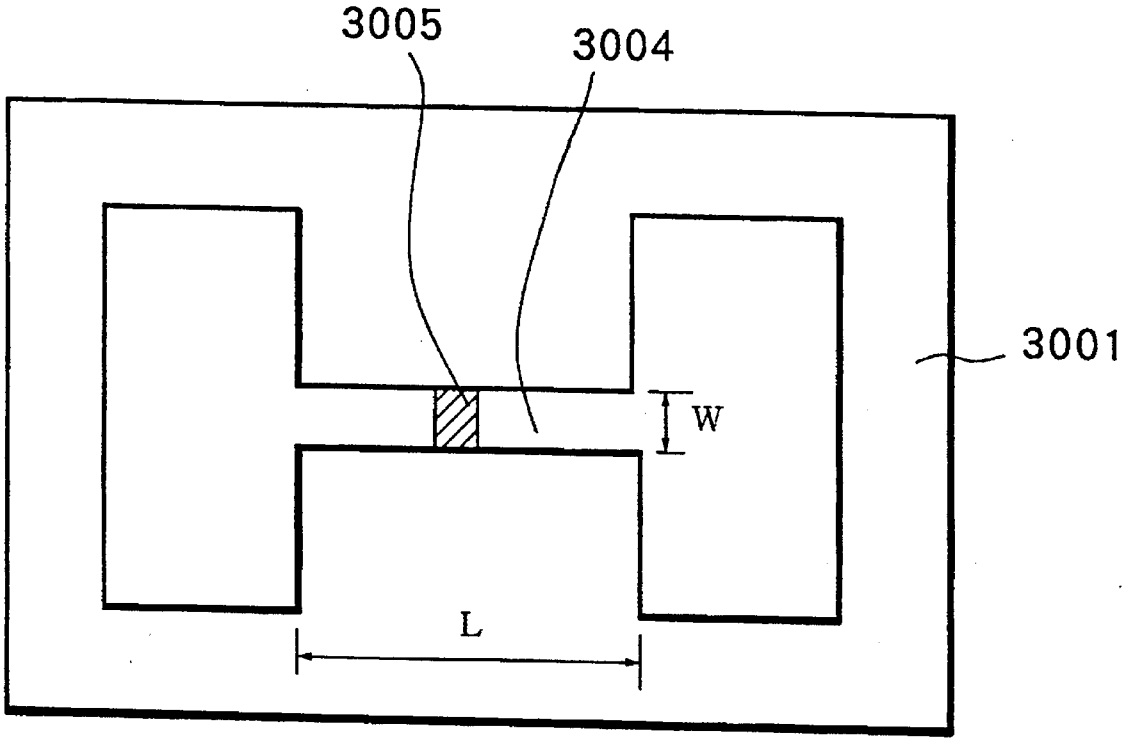
FIG. 23 is a plan view of a conventional surface conduction electron emitting device.

FIG. 21 is a block diagram showing an embodiment of a multifunction display apparatus which uses the image display apparatus of the second embodiment and can display image information provided by various image information sources such as television broadcasting.

In FIG. 21, reference numerals 2100 denotes an image display apparatus of the second embodiment; 2101, a display panel driver; 2102, a display controller; 2103, a multiplexer; 2104, a decoder; 2105, an I/O interface circuit; 2106, a CPU; 2107, an image generator; 2108, 2109, and 2110, image memory interface circuits; 2111, an image input interface circuit; 2112 and 2113, TV signal receivers; and 2114, an input unit.

When this display apparatus is to receive a signal containing both video information and audio information, e.g., a television signal, the apparatus displays images and, of course, reproduces voices at the same time. However, a description of circuits and loudspeakers for reception, separation, reproduction, processing, and storage of voice information will be omitted, since these parts are not directly related to the characteristic features of the present invention.

The functions of the individual parts will be described below following the flow of an image signal.

The TV signal receiver 2113 is a circuit for receiving a TV image signal transmitted using a radio transmission system such as radio waves or space optical communication. The system of the TV signal to be received is not particularly limited. Examples are NTSC, PAL, and SECAM. A TV signal (e.g., a so-called high-definition TV signal such as the one of MUSE) consisting of a larger number of scanning lines than those of the systems enumerated above is a signal source suited to take advantage of the full performance of the above display panel which is preferable in increasing the screen area and the number of pixels. The TV signal received by the TV signal receiver 2113 is output to the decoder 2104.

The TV signal receiver 2112 is a circuit for receiving a TV image signal transmitted using a cable transmission System such as a coaxial cable or an optical fiber. As in the case of the TV signal receiver 2113, the system of the TV signal to be received is not particularly limited. The TV signal received by this circuit is also output to the decoder 2104.

The image input interface circuit 2111 receives an image signal supplied from an image input device such as a TV camera or an image reading scanner. The received image signal is output to the decoder 2104.

The image memory interface circuit 2110 receives an image signal stored in a video tape recorder (to be abbreviated as a VTR hereinafter). The received image signal is output to the decoder 2104.

The image memory interface circuit 2109 receives an image signal stored in a video disk. The received image signal is output to the decoder 2104.

The image memory interface circuit 2108 receives an image signal from a device storing still image data, such as a so-called still image disk. The still image data received is output to the decoder 2104.

The I/O interface circuit 2105 connects this display apparatus to an external computer or computer network or to an output apparatus such as a printer.

The I/O interface circuit 2105 performs input/output of image data and character-graphic information. In some cases, the I/O interface circuit 2105 can also perform input/output of control signals and numerical data between the CPU 2106 of this display apparatus and an external equipment.

The image generator 2107 generates image data to be displayed on the basis of image data or character graphic information that is externally input via the I/O interface circuit 2105, or on the basis of output image data or character-graphic information from the CPU 2106. The image generator 2107 incorporates circuits required for generation of images, such as a programmable memory for storing image data or character graphic information, a read-only memory which stores image patterns corresponding to character codes, and a processor for performing image processing.

The image data to be displayed generated by the image generator 2107 is output to the decoder 2104. In some instances, it is also possible to output the data to an external computer network or a printer via the I/O interface circuit 2105.

The CPU 2106 primarily controls the operation of this display apparatus and performs works concerning generation, choice, and edit of images to be displayed.

For example, the CPU 2106 outputs a control signal to the multiplexer 2103 to properly select and combine image signals to be displayed on the display panel. During the processing, the CPU 2106 also outputs a control signal to the display panel controller 2102 in accordance with the image signals to be displayed, thereby appropriately controlling the operating conditions of the display apparatus, e.g., the screen display frequency, the scanning method (e.g., interlace or noninterlace), and the number of scanning lines in one frame.

In addition, the CPU 2106 directly outputs image data or character graphic information to the image generator 2107, or receives image data or character•graphic information by accessing an external computer or memory via the I/0 interface circuit 2105.

Note that the CPU 2106, of course, can participate in works for.some other purposes. As an example, the CPU 2106 can directly take part in a function of generating or processing information, as in a personal computer or a wordprocessor.

Also, the CPU 2106 can be connected to an external computer network via the I/O interface circuit 2105 as described above to perform works such as numerical computations in cooperation with the external equipment.

The input unit 2114 is used by an operator to input commands, programs, or data to the CPU 2106. It is possible to use various input devices such as a keyboard, a mouse, a joy stick, a bar-code reader, and a voice recognition device.

The decoder 2104 is a circuit for decoding various input image signals from the image circuits 2107 to 2113 into signals of three primary colors, or into a luminance signal and I and Q signals. As indicated by the dotted lines in FIG. 21, it is desirable that the decoder 2104 include an internal image memory. This is so because TV signals such as MUSE signals which require an image memory in decoding are handled in this apparatus. The image memory also makes still images easier to display. Another advantage to the use of the image memory is that the image memory facilitates image processing and edit, such as thinning, interpolation, enlargement, reduction, and synthesis of images, in cooperation with the image generator 2107 and the CPU 2106.

The multiplexer 2103 properly selects an image to be displayed on the basis of the input control signal from the CPU 2106. That is, the multiplexer 2103 selects a desired image signal from the input image signals decoded by the decoder 2104 and outputs the selected signal to the driver 2101. In this case, it is possible to divide a frame into a plurality of regions and display different images in these regions, as in a so-called multi-screen television system, by switching image signals within a display time of one frame.

The display panel controller 2102 controls the operation of the driver 2101 on the basis of the input control signal from the CPU 2106.

That is, to control the basic operation of the display panel, the display panel controller 2102 outputs to the driver 2101 a signal for controlling the Operation sequence of a power supply (not shown) for driving the display panel.

In addition, to control the display panel driving method, the display panel controller 2102 outputs a signal for controlling the screen display frequency or the scanning method (e.g., interlace or noninterlace) to the driver 2101.

Also, depending on the situation, the display panel controller 2102 outputs to the driver 2101 control signals for adjusting the image quality, e.g., the brightness, contrast, tone, or sharpness of display images.

The driver 2101 is a circuit for generating a driving signal to be applied to the display panel 2100. The driver 2101 operates on the basis of the input image signal from the multiplexer 2103 and the input control signal from the display panel controller 2102.

The functions of the individual parts have been described above. With the arrangement illustrated in FIG. 21, this multifunction display apparatus can display input image information from various image information sources on the display panel 2100.

More specifically, various image signals such as TV broadcasting signals are decoded by the decoder 2104, properly selected by the multiplexer 2103, and applied to the driver 2101. The display controller 2102 generates a control signal for controlling the operation of the driver 2101 in accordance with the image signal to be displayed. On the basis of the image signal and the control signal, the driver 2101 applies the driving signal to the display panel 2100.

Consequently, the image is displayed on the display panel 2100. A series of these operations are controlled by the CPU 2106.

Also, in this multifunction display apparatus, the internal image memory of the decoder 2104, the image generator 2107, and the CPU 2106 operate in cooperation with each other. This makes it possible not only to simply display a selected one of a plurality of pieces of image information but also to perform image processing such as enlargement, reduction, rotation, movement, edge emphasis, thinning, interpolation, color conversion, and aspect ratio conversion, and image edit such as synthesis, erasure, connection, switching, and pasting. Furthermore, although not particularly touched upon in the description of this embodiment, dedicated circuits for performing processing and edit for voice information can also be provided, as well as those for the image processing and image edit described above.

This multifunction display apparatus, therefore, can singly serve as a television broadcasting display apparatus, a terminal of a television conference, an image edit apparatus for processing still and motion images, a display of a computer, an office terminal equipment such as a wordprocessor, and a game machine. That is, this multifunction display apparatus can be used as either an industrial or consumer system in an extremely wide range of applications.

Note that FIG. 21 shows only one practical example of the arrangement of the multifunction display apparatus, so the apparatus, of course, is not limited to this example. For instance, circuits for functions unnecessary to the intended use may be omitted from the arrangement illustrated in FIG. 21. Conversely, other constituent elements may be added Go the arrangement depending on the intended application. As an example, when this display apparatus is to be applied to a television telephone set, it is preferable to add to the arrangement a TV camera, a microphone, an illuminator, and a transmitter/receiver circuit including a modem.

In this multifunction display apparatus, the display panel using the surface conduction electron emitting devices as electron beam sources can be readily made thin. Consequently, the depth of the entire display apparatus can be decreased. In addition, the display panel using the surface conduction electron emitting devices as electron beam sources can be readily increased in screen size and has a high luminance and a wide viewing angle. Therefore, this display apparatus can display real, impressive images with a high visibility.

According to the present invention, as has been described above, in an electron beam generating apparatus or an image display apparatus including a large number of surface conduction electron emitting devices, it is possible to correct variations in the electron emission characteristics of the surface conduction electron emitting devices in the initial stages after the fabrication.

In addition, by focusing attention on the inherent characteristic of the surface conduction electron emitting device, i.e., the close correlation between the device current and the emission current, the present invention makes it possible to detect a change with time of the surface conduction electron emitting device with a very simple circuit configuration. That is, in measuring the device current of the surface conduction electron emitting device, the present invention requires neither an ammeter nor a luminance meter which withstands high voltages, unlike in measurement of the emission current or the luminance of the display screen. Consequently, a change in the characteristic of each device can be readily detected.

In the present invention, a correction value for driving conditions is adjusted if a change with time is detected. This allows each surface conduction electron emitting device to output a proper electron beam for a long period of time. As a consequence, the performance of an electron beam generating apparatus or of an image display apparatus can be kept stable over a long time period.

As many apparently widely different embodiments of the present invention can be made without departing from the spirit and scope thereof, it is to be understood that the invention is not limited to the specific embodiments thereof except as defined in the appended claims.

What is claimed is:

1. An electron beam generating apparatus for an electron beam source including surface conduction electron emitting devices formed on a substrate, comprising:

measuring means for measuring a device current flowing through each of said surface conduction electron emitting devices;

device current storage means for storing data measured by said measuring means;

comparing means for comparing latest data measured by said measuring means with the data stored in said device current storage means;

correction value storage means for storing a correction value for correcting a driving signal to be applied to each surface conduction electron emitting device; and adjusting means for adjusting the correction value stored in said correction value storage means.

2. An apparatus according to claim 1, wherein said measuring means measures the device current by applying a voltage lower than an electron emission threshold voltage of said surface conduction electron emitting devices.

3. An apparatus according to claim 1, wherein said surface conduction electron emitting devices are connected in a matrix manner by row-direction lines and column-direction lines, the driving signal to be applied to said surface conduction electron emitting devices includes a scan signal applied from said row-direction lines and a modulated signal applied from said column-direction line and the modulated signal is corrected by the correction value stored in said correction value storage means.

4. An image display apparatus including surface conduction electron emitting devices formed on a substrate and a phosphor which emits visible light when irradiated with an electron beam, comprising:

measuring means for measuring a device current flowing through each of said surface conduction electron emitting devices;

device current storage means for storing data measured by said measuring means;

comparing means for comparing latest data measured by said measuring means with the data stored in said device current storage means;

correction value storage means for storing a correction value for correcting a driving signal to be applied to each surface conduction electron emitting device; and adjusting means for adjusting the correction value stored in said correction value storage means.

5. An apparatus according to claim 4, wherein said measuring means measures the device current by applying a voltage lower than an electron emission threshold voltage of said surface conduction electron emitting devices.

6. An apparatus according to claim 4, wherein said surface conduction electron emitting devices are connected in a matrix manner by row-direction lines and column-direction lines, the driving signal to be applied to said surface conduction electron emitting devices includes a scan signal applied from said row-direction lines and a modulated signal applied from said column- direction lines, and the modulated signal is corrected by the correction value stored in said correction value storage means.

7. A method of driving an image display apparatus including surface conduction electron emitting devices formed on a substrate, a phosphor which emits visible light when irradiated with an electron beam, measuring means for measuring a device current flowing through each of said surface conduction electron emitting devices, device current storage means for storing data measured by said measuring means, comparing means for comparing latest data measured by said measuring means with the data stored in said device current storage means, correction value storage means for storing a correction value for correcting a driving signal to be applied to each surface conduction electron emitting device, and adjusting means for adjusting the correction value stored in said correction value storage means, comprising the steps of:

storing with said device current storage means measured values of device currents in initial stages after fabrication of said surface conduction electron emitting devices;

storing with said correction value storage means, as an initial value, a correction value determined on the basis of the measured value of the initial device current of each surface conduction electron emitting device;

measuring with said device current measuring means the device current after an image is displayed for an arbitrary time period;

comparing with said comparing means latest data measured by said device current measuring means after driving for the arbitrary time period with the data stored in said device current storage means; and adjusting with said adjusting means the correction value stored in said correction value storage means if the comparison result exceeds a predetermined range.

8. A method of driving an image display apparatus including surface conduction electron emitting devices formed on a substrate, a phosphor which emits visible light when irradiated with an electron beam, measuring means for measuring a device current flowing through each of said surface conduction electron emitting devices, device current storage means for storing data measured by said measuring means, comparing means for comparing latest data measured by said measuring means with the data stored in said device current storage means, correction value storage means for storing a correction value for correcting a driving signal to be applied to each surface conduction electron emitting device, and adjusting means for adjusting the correction value stored in said correction value storage means, comprising the steps of:

storing with said device current storage means measured values of device currents in initial stages after fabrication of said surface conduction electron emitting devices;

storing with said correction value storage means,as an initial value, a correction value determined on the basis of a measured value of an initial emission current of each surface conduction electron emitting device;

measuring with said device current measuring means the device current after an image is displayed for an arbitrary time period;

comparing with said comparing means latest data measured by said device current measuring means after driving for the arbitrary time period with the data stored in said device current storage means; and adjusting with said adjusting means the correction value stored in said correction value storage means if the comparison result exceeds a predetermined range.

9. A method of driving an image display apparatus including surface conduction electron emitting devices formed on a substrate, a phosphor which emits visible light when irradiated with an electron beam, measuring means for measuring a device current flowing through each of said surface conduction electron emitting devices, device current storage means for storing data measured by said measuring means, comparing means for comparing latest data measured by said measuring means with the data stored in said device current storage means, correction value storage means for storing a correction value for correcting a driving signal to be applied to each surface conduction electron emitting device, and adjusting means for adjusting the correction value stored in said correction value storage means, comprising the steps of:

storing with said device current storage means measured values of device currents in initial stages after fabrication of said surface conduction electron emitting devices;

storing with said correction value storage means,as an initial value, a correction value determined on the basis of a measured value of luminance obtained when each surface conduction electron emitting device emits an electron beam onto said phosphor;

measuring with said device current measuring means the device current after an image is displayed for an arbitrary time period;

comparing with said comparing means latest data measured by said device current measuring means after driving for the arbitrary time period with the data stored in said device current storage means; and adjusting with said adjusting means the correction value stored in said correction value storage means if the comparison result exceeds a predetermined range.

* * * * *

UNITED STATES PATENT AND TRADEMARK OFFICE

CERTIFICATE OF CORRECTION

PATENT NO. : 5,659,328

DATED : August 19, 1997

INVENTOR(S) : Todokoro et al.

It is certified that error appears in the above-identified patent and that said Letters Patent is hereby corrected as shown below:

On the title page:Item

[56] References Cited:

U.S. PATENT DOCUMENTS

"4,954,744 9/1990 Suziuki et al." should read --4,954,744 9/1990 Suzuki--.

[30] Foreign Application Priority Data:

"Japan ..... 5-32373" should read --Japan ..... 5-323773--.

IN THE DRAWINGS:

Sheet 15 of 23, Figure 15A

Include complete titles --ACTIVATION POWER SUPPLY-- and --OUTPUT VOLTAGE--.

COLUMN 1:

Line 21, "emission" should read --Emission--, and "Advance" should read --Advances--; and Line 23, "molybdenium" should read --molybdenum--.

UNITED STATES PATENT AND TRADEMARK OFFICE

CERTIFICATE OF CORRECTION

PATENT NO. : 5,659,328

DATED : August 19, 1997

INVENTOR(S) : Todokoro et al.

It is certified that error appears in the above-identified patent and that said Letters Patent is hereby corrected as shown below:

COLUMN 3:

Line 47, "rows-columns" should read --rows and columns--.

COLUMN 4:

Line 7, "this for that" should read --that for this--.

COLUMN 8:

Line 24, "serials/parallel" should read --serial/parallel--.

COLUMN 16:

Line 38, "ban" should read --can--.

COLUMN 20:

Line 6, "$10_3$" should read --$10^3$--; and
Line 7, "$10_7$" should read --$10^7$--.

COLUMN 30:

Line 45, "Go" should read --to--.

UNITED STATES PATENT AND TRADEMARK OFFICE

CERTIFICATE OF CORRECTION

PATENT NO. : 5,659,328

DATED : August 19, 1997

INVENTOR(S) : Todokoro et al.

It is certified that error appears in the above-identified patent and that said Letters Patent is hereby corrected as shown below:

"Column 31, line 55, "line" should read --lines,--."

Signed and Sealed this

Twenty-first Day of July, 1998

Bruce Lehman

*Attest:*

BRUCE LEHMAN

*Attesting Officer*

*Commissioner of Patents and Trademarks*